US010012353B2

(12) United States Patent
Gould et al.

(10) Patent No.: US 10,012,353 B2
(45) Date of Patent: Jul. 3, 2018

(54) RECESSED LUMINAIRE

(71) Applicant: ABL IP Holding LLC, Conyers, GA (US)

(72) Inventors: Carl Gould, Golden, CO (US); Peter K. Nelson, Denver, CO (US); Chris Sorensen, Denver, CO (US); Chris Slaughter, Denver, CO (US); Kevin F. Leadford, Evergreen, CO (US)

(73) Assignee: ABL IP Holding LLC, Atlanta, GA (US)

( * ) Notice: Subject to any disclaimer, the term of this patent is extended or adjusted under 35 U.S.C. 154(b) by 394 days.

(21) Appl. No.: 14/427,588

(22) PCT Filed: Sep. 11, 2013

(86) PCT No.: PCT/US2013/059306

§ 371 (c)(1),
(2) Date: Mar. 11, 2015

(87) PCT Pub. No.: WO2014/043268

PCT Pub. Date: Mar. 20, 2014

(65) Prior Publication Data

US 2015/0226392 A1 Aug. 13, 2015

Related U.S. Application Data

(63) Continuation of application No. 13/866,971, filed on Apr. 19, 2013, and a continuation of application No. 13/866,939, filed on Apr. 19, 2013, now abandoned.

(Continued)

(51) Int. Cl.

*F21V 13/00* (2006.01)
*F21S 8/02* (2006.01)

(Continued)

(52) U.S. Cl.

CPC ..... *F21S 8/024* (2013.01); *F21V 5/00* (2013.01); *F21V 7/0016* (2013.01); *F21V 13/02* (2013.01);

(Continued)

(58) Field of Classification Search

CPC ..... F21V 21/02; F21V 21/047; F21V 21/044; F21V 21/042; F21V 21/045;

(Continued)

(56) References Cited

U.S. PATENT DOCUMENTS 1,348,957 A * 8/1920 Pope ..... G09F 13/04 315/294
1,480,375 A * 1/1924 Cristadoro ..... G09G 3/004 40/444

(Continued)

FOREIGN PATENT DOCUMENTS

WO 2014/043268 A1 3/2004

OTHER PUBLICATIONS

Non-Final Office Action for U.S. Appl. No. 13/866,971, dated Jan. 7, 2016, 21 pages.

(Continued)

*Primary Examiner* — Bryon T Gyllstrom
*Assistant Examiner* — James Endo
(74) *Attorney, Agent, or Firm* — Kilpatrick Townsend & Stockton LLP

(57) ABSTRACT

A two-component luminaire for illuminating an architectural space includes a housing with a panel that faces the architectural space. A peripheral edge of the housing, having first and second edge segments, forms an output aperture that faces the architectural space. A plane bisecting the output aperture defines a boundary between an indirect lighting region and a direct lighting region. The luminaire includes a primary optical subsystem arranged within the housing so as (Continued)

to be hidden from the direct lighting region by the first panel section, and configured to generate and emit light, through the output aperture, solely into the indirect lighting region, and a secondary optical subsystem, disposed within the housing and configured to generate and emit light through the output aperture.

27 Claims, 20 Drawing Sheets

Related U.S. Application Data

(60) Provisional application No. 61/699,459, filed on Sep. 11, 2012, provisional application No. 61/784,748, filed on Mar. 14, 2013.

(51) Int. Cl.

| | |
|---|---|
| ***F21V 13/02*** | (2006.01) |
| ***H05B 37/02*** | (2006.01) |
| ***F21V 5/00*** | (2018.01) |
| ***F21V 7/00*** | (2006.01) |
| ***F21V 23/00*** | (2015.01) |
| *F21S 6/00* | (2006.01) |
| *F21V 21/02* | (2006.01) |
| *F21V 5/08* | (2006.01) |
| *F21V 21/04* | (2006.01) |
| *F21S 8/00* | (2006.01) |
| *F21K 9/62* | (2016.01) |
| *F21Y 105/00* | (2016.01) |
| *F21Y 115/10* | (2016.01) |
| *F21Y 115/15* | (2016.01) |
| *F21Y 113/13* | (2016.01) |
| *F21V 29/76* | (2015.01) |
| *F21Y 103/10* | (2016.01) |

(52) U.S. Cl.
CPC ..... *F21V 23/009* (2013.01); *H05B 37/02* (2013.01); *F21K 9/62* (2016.08); *F21S 6/008* (2013.01); *F21S 8/033* (2013.01); *F21V 5/08* (2013.01); *F21V 21/025* (2013.01); *F21V 21/04* (2013.01); *F21V 29/76* (2015.01); *F21Y 2103/10* (2016.08); *F21Y 2105/00* (2013.01); *F21Y 2113/13* (2016.08); *F21Y 2115/10* (2016.08); *F21Y 2115/15* (2016.08); *H05B 37/0209* (2013.01)

(58) Field of Classification Search
CPC ..... F21V 21/046; F21V 21/048; F21V 21/04; F21V 21/025; F21V 7/0016; F21V 7/0008; F21V 7/0041; F21V 23/009; F21V 29/507; F21V 13/02; F21V 5/08; F21S 8/02; F21S 8/024; F21S 8/026; F21S 8/033; F21S 8/036; F21S 8/043; F21S 8/008; F21S 8/031; F21S 8/00; F21S 10/023; F21Y 2113/02; F21K 9/62; G09F 2013/0422
USPC ..... 40/444, 442, 562, 563, 582
See application file for complete search history.

(56) References Cited

U.S. PATENT DOCUMENTS 1,937,139 A * 11/1933 Barclay ..... G09F 13/0409 359/619
3,700,880 A * 10/1972 Smith ..... F21S 10/007 362/811
4,490,776 A 12/1984 Kluch et al.
5,285,356 A 2/1994 Skene et al.
5,662,403 A 9/1997 Akashi et al.
5,977,694 A 11/1999 McGuire
6,011,650 A 1/2000 Parker et al.
6,363,636 B1 4/2002 Hess et al.
6,393,207 B1 5/2002 Martin et al.
6,461,032 B2 10/2002 McKinley
6,608,453 B2 8/2003 Morgan et al.
6,690,120 B2 2/2004 Oskorep et al.
6,789,914 B1 9/2004 Brown et al.
6,798,154 B1 9/2004 Sullivan et al.
6,932,487 B2 8/2005 Aknine
6,944,982 B2 9/2005 Schroeter et al.
7,090,375 B2 8/2006 Kuisma
7,246,919 B2 7/2007 Porchia et al.
7,322,136 B2 1/2008 Chen et al.
7,348,736 B2 3/2008 Piepgras et al.
7,502,170 B2 * 3/2009 Nakano ..... G01N 21/8806 359/290
7,604,378 B2 10/2009 Wolf et al.
7,614,767 B2 11/2009 Zulim et al.
7,658,506 B2 2/2010 Dowling
7,845,823 B2 12/2010 Mueller et al.
8,100,552 B2 1/2012 Spero
8,425,101 B2 4/2013 Boonekamp
2003/0034985 A1 * 2/2003 Needham Riddle ..... G01J 1/08 345/589
2003/0179574 A1 9/2003 Kuisma
2004/0052076 A1 3/2004 Mueller et al.
2004/0120160 A1 6/2004 Natsume
2004/0125610 A1 * 7/2004 Lekson ..... F21S 2/005 362/487
2005/0265023 A1 * 12/2005 Scholl ..... H01J 61/72 362/229
2006/0072317 A1 4/2006 Noordhoek
2006/0238136 A1 10/2006 Johnson et al.
2006/0277857 A1 12/2006 Bonshor
2007/0081362 A1 4/2007 Lin
2007/0147036 A1 6/2007 Sakai et al.
2007/0171676 A1 7/2007 Chang
2007/0206375 A1 9/2007 Piepgras et al.
2007/0217193 A1 9/2007 Lin et al.
2007/0263379 A1 11/2007 Dowling
2007/0263393 A1 11/2007 van de Ven
2008/0130282 A1 6/2008 Negley
2008/0170380 A1 7/2008 Pastore
2008/0204888 A1 8/2008 Kan et al.
2008/0259596 A1 * 10/2008 Biebl ..... F21V 7/0008 362/228
2008/0273323 A1 11/2008 Ladstaetter
2009/0002986 A1 1/2009 Medendorp, Jr. et al.
2009/0243455 A1 * 10/2009 Biebel ..... F21S 8/04 313/1
2009/0244893 A1 10/2009 Villard
2009/0290348 A1 11/2009 Van Laanen et al.
2010/0079087 A1 * 4/2010 Watanabe ..... F21S 8/04 315/294
2010/0225639 A1 9/2010 Kubis et al.
2010/0237803 A1 9/2010 Wolf et al.
2010/0246174 A1 9/2010 Ido et al.
2010/0290208 A1 11/2010 Pickard
2010/0309647 A1 * 12/2010 Winkler ..... C09K 11/7734 362/84
2010/0321919 A1 12/2010 Yang
2011/0002114 A1 * 1/2011 Koerner ..... A47F 3/001 362/126
2011/0002682 A1 * 1/2011 Messina ..... F21V 7/0008 396/200
2011/0008035 A1 1/2011 Messina et al.
2011/0019408 A1 1/2011 Jang
2011/0058358 A1 * 3/2011 Soo ..... F21S 8/02 362/147
2011/0187273 A1 8/2011 Summerford et al.
2011/0199765 A1 8/2011 Simons
2011/0267839 A1 11/2011 Kang et al.
2012/0002406 A1 1/2012 Leadford et al.
2012/0002408 A1 1/2012 Lichten et al.
2012/0044675 A1 2/2012 Buelow et al.

(56) References Cited

U.S. PATENT DOCUMENTS

| | | | | |
|---|---|---|---|---|
| 2012/0112661 | A1* | 5/2012 | van de Ven | H05B 33/0803 315/294 |
| 2013/0020956 | A1 | 1/2013 | Zhang et al. | |
| 2013/0033865 | A1* | 2/2013 | Vinther | F21V 7/0083 362/235 |
| 2013/0258688 | A1 | 10/2013 | Kalapodas | |
| 2014/0070724 | A1 | 3/2014 | Gould et al. | |
| 2014/0071673 | A1 | 3/2014 | Gould et al. | |

OTHER PUBLICATIONS

Office Action for Canadian Application No. CA 2,883,639, dated Mar. 16, 2016, 4 pages.
Final Office Action for U.S. Appl. No. 13/866,971, dated May 20, 2016, 33 pages.
Advisory Action for U.S. Appl. No. 13/866,971, dated Oct. 3, 2016, 4 pages.
Non-Final Office Action for U.S. Appl. No. 13/866,971, dated Mar. 22, 2017, 34 pages.
Office Action for Canadian Application No. CA 2,883,639, dated Mar. 3, 2017, 3 pages.
PCT/US2013/059306 International Search Report and Written Opinion, dated Feb. 19, 2014.
Selected file history of U.S. Appl. No. 13/866,971 from Apr. 19, 2013-Mar. 13, 2014.
Selected file history of U.S. Appl. No. 13/866,939 from Apr. 19, 2013-Jul. 9, 2014.
Notice of Allowance for U.S. Appl. No. 13/866,971, dated Dec. 14, 2017, 10 pages.
Final Office Action for U.S. Appl. No. 13/866,971, dated Aug. 4, 2017, 18 pages.
Notice of Allowance for Canadian Application No. CA 2,883,639, dated Jul. 31, 2017, 1 page.

* cited by examiner

RECESSED LUMINAIRE

CROSS REFERENCE TO RELATED APPLICATIONS

This application is a 35 USC § 371 U.S. National Stage Entry of, and claims the benefit of priority to, PCT Application Serial No. PCT/US2013/059306 (WO 2014/043268), filed on Sep. 11, 2013, which claims the benefit of priority to U.S. Non-Provisional patent application Ser. No. 13/866,939, filed Apr. 19, 2013, entitled "Recessed Luminaire," and U.S. Non-Provisional patent application Ser. No. 13/866,971, filed Apr. 19, 2013, entitled "Recessed Luminaire." This application and both of the above-identified applications also claim the benefit of priority to U.S. Provisional Patent Application No. 61/699,459, filed Sep. 11, 2012, entitled "Wall-Recessed Two Component Luminaire," and U.S. Provisional Patent Application No. 61/784,748, filed Mar. 14, 2013, entitled "Wall-Recessed Two Component Luminaire." The above-identified applications are hereby incorporated by reference in their entireties for all purposes.

BACKGROUND

Rooms and other architectural spaces are often illuminated by either natural light or by artificial light. Natural light has many benefits over artificial light, but may not be available or be practical. An advantageous arrangement for some spaces may be a combination of artificial and natural light. Imitation windows exist, but they are typically mounted on the wall and only emit a single type of light. This tends to give the appearance of a television screen or backlit sign/poster on the wall and fails to provide either the type or amount of light necessary to light the room. Indirect lighting schemes exist whereby light is projected onto one or more walls or ceilings of an architectural space; a portion of the projected light reflects into the space for general illumination of the space. Such indirect lighting schemes may provide diffuse light that is bright in the vicinity of its source and dim further away from the source. In such systems, the bright light in the vicinity of the source may be distracting while the dim light further away from the source may be undesirably weaker than desired for task lighting within the entire room or architectural space. Accent lighting also exists wherein light of one or more individual colors may be provided and/or may be projected upon surfaces. However, colored lighting alone is usually considered an inferior choice for general illumination because humans expect to be able to see color differences among objects, which are best discerned under white light.

BRIEF SUMMARY

The terms "invention," "the invention," "this invention," and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the invention are directed to wall recessed two-component luminaires. The two components can include a primary optical subsystem and a secondary optical subsystem. In some embodiments, the primary optical subsystem can provide indirect lighting, illuminate an architectural space indirectly by projecting light upward toward a ceiling, and/or provide light with more lumens than the secondary optical subsystem. In some embodiments, the secondary optical subsystem can provide direct lighting, illuminate an architectural space horizontally and/or downward, provide lit appearance, direct view color, direct view luminance, and/or lighting for ambience.

A two-component luminaire for illuminating an architectural space includes at least a housing, and at least a panel that faces the architectural space. A peripheral edge of the housing forms an output aperture that faces the architectural space, with a first edge segment of the peripheral edge bounding a first panel section of the panel, and a second edge segment of the peripheral edge being across the output aperture from the first edge segment. A plane normal to the panel and bisecting the output aperture defines a boundary between an indirect lighting region and a direct lighting region, wherein the first edge segment and first panel section are within the direct lighting region, and the second edge segment is within the indirect lighting region. The luminaire further includes a primary optical subsystem that is arranged within the housing so as to be hidden from the direct lighting region by the first panel section, and configured to generate and emit light, through the output aperture, solely into the indirect lighting region, and a secondary optical subsystem, disposed within the housing and configured to generate and emit light through the output aperture.

A method of illuminating an architectural space includes providing a luminaire within a recess of a wall of the architectural space. The luminaire includes a housing, a first primary optical subsystem configured to emit a first light solely towards an indirect lighting region of the architectural space, while being hidden, by the housing, from view of a direct lighting region of the architectural space, and a first secondary optical subsystem. The method further includes activating the first primary optical subsystem to provide the first light into the indirect lighting region of the architectural space, and activating the first secondary optical subsystem to provide a second light into at least the direct lighting region of the architectural space.

A luminaire for illuminating an architectural space includes a housing that forms an output aperture facing the architectural space, and one or more optical subsystems, disposed within the housing, each of the optical subsystems including a plurality of red, green and blue light sources that are distributed in each of horizontal and vertical directions within the housing. The luminaire further includes a diffuser that at least partially mixes light from the light sources such that mixed light therefrom is visible through the output aperture. The red, green and blue light sources and the diffuser are arranged and independently controllable so as to create at least one of horizontal and vertical gradients of at least one of color and intensity when viewed from the architectural space.

A luminaire for illuminating an architectural space includes a housing that forms an output aperture facing the architectural space. The housing and the output aperture may be substantially rectangular. The output aperture forms a peripheral edge, such that first and fourth segments of the peripheral edge at respective upper and lower sides of the output aperture are substantially horizontal, and second and third edge segments of the peripheral edge along sides of the output aperture are substantially vertical, when the luminaire is installed. The housing includes first, second and third sidewalls extending perpendicularly into the housing from the output aperture, wherein the first sidewall adjoins the first segment of the peripheral edge and extends perpendicularly into the housing therefrom, and the second and third sidewalls adjoin the second and third segments of the peripheral edge respectively, and extend perpendicularly into the housing therefrom. The luminaire includes one or more optical subsystems, disposed within the housing, each of the optical subsystems including a plurality of independently controllable red, green and blue light sources, and/or a diffuser, disposed behind the sidewalls from the architectural space, that at least partially mixes light from the light sources such that light mixed thereby is visible through the output aperture.

BRIEF DESCRIPTION OF THE DRAWINGS

Illustrative embodiments of the present invention are described in detail below with reference to the following figures.

DETAILED DESCRIPTION

Figure 1A:
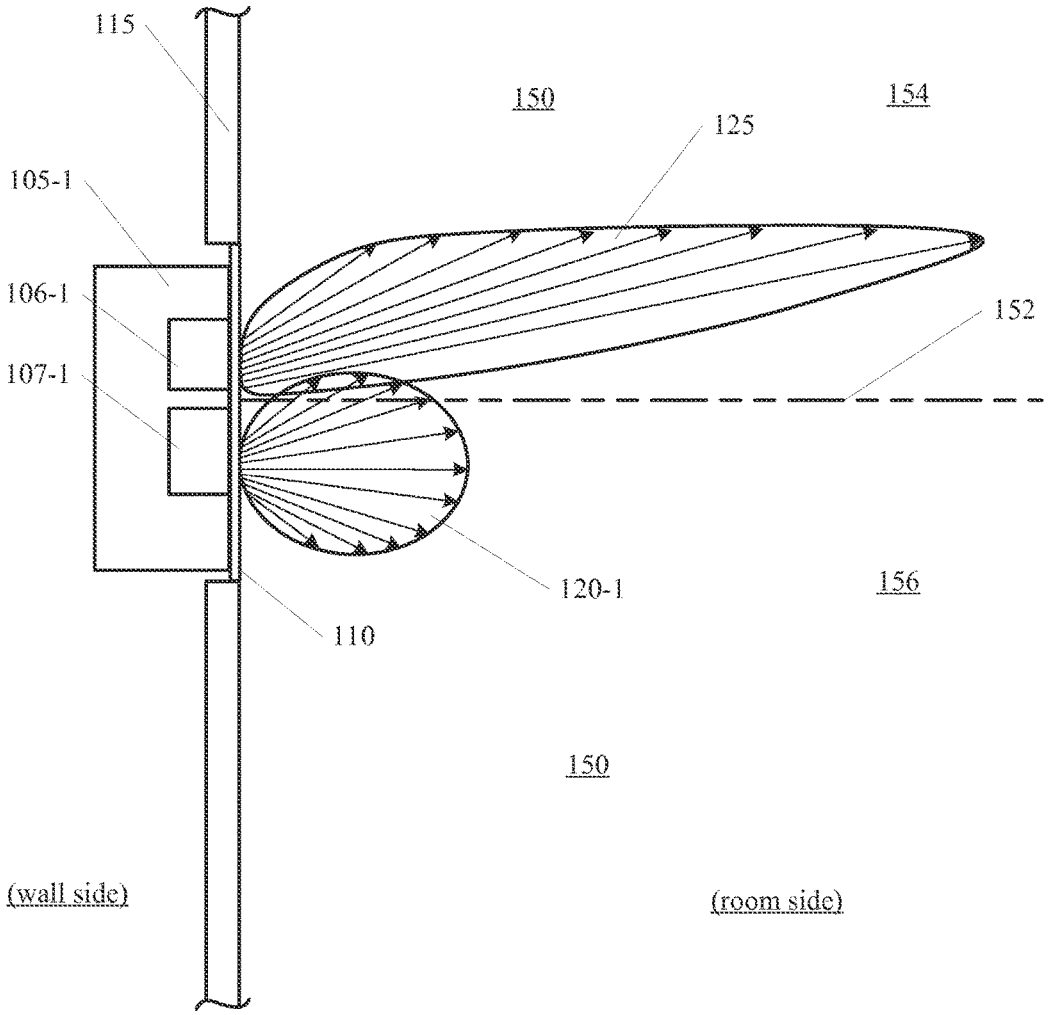
FIG. 1A schematically shows a photometric distribution from a primary optical subsystem and a secondary optical subsystem of a wall recessed two-component luminaire according to some embodiments of the invention.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Variants of certain embodiments or features thereof are sometimes labeled with a reference numeral followed by a dash and a subnumeral; in such cases, references in the text that are not followed by a dash are intended to refer to such features across all possible subnumerals (e.g., luminaires 200-1, 200-2 are all examples of a luminaire 200).

Embodiments of the invention are directed toward a two component, wall recessed (or surface mounted) luminaire that includes a primary optical subsystem and a secondary optical subsystem. In some embodiments, the primary optical subsystem can be configured to illuminate while the secondary optical subsystem can be configured to provide aesthetic lighting. Various different examples, embodiments and configurations of this general concept are described below.

In some embodiments, each subsystem may include one or more light sources, lenses, reflectors, collimators, diffusing optical elements, controllers, hardware, etc. Generally speaking, a primary optical subsystem can direct light in one direction relative to the luminaire to provide indirect lighting within an architectural space. The secondary optical subsystem can direct light in a different direction to directly illuminate the architectural space, provide lit appearance, provide direct view color, and/or provide direct view luminance. For example, the primary optical subsystem may direct light upwardly to provide indirect lighting that reflects from a ceiling back down into the architectural space, while the secondary optical subsystem directs light at least downwardly into the architectural space (and, optionally, directs light both upwardly and downwardly). In some embodiments, both the primary optical subsystem and the secondary optical subsystem illuminate the architectural space from the same wall cavity or from a housing designed to be inserted into a wall. In some embodiments, this combination of primary and secondary optical subsystems can provide an illumination within the architectural space that shares qualities of or is suggestive of natural light from a window, portal, or translucent architectural element (e.g., glass block).

Any or all of the embodiments herein may include only a primary optical subsystem, a secondary optical subsystem, or both types. As discussed below, it may be particularly advantageous, in certain applications, to provide a mix of luminaires having different capabilities, for example to provide adequate task lighting from only some luminaires that include primary optical subsystems, while providing accent lighting from all luminaires that include secondary optical subsystems.

FIG. 1A schematically shows a block diagram example of a photometric distribution from a primary optical subsystem 106-1 and a secondary optical subsystem 107-1 through a front optical element 110, according to some embodiments of the invention. The blocks showing primary optical subsystem 106-1, secondary optical subsystem 107-1 and front optical element 110 are functional block diagrams only and may not represent actual position of such elements in embodiments. Luminaire 105-1 is shown recessed within wall 115 behind front optical element 110. Luminaire 105-1 includes primary optical subsystem 106-1 and secondary optical subsystem 107-1. Each optical subsystem 106-1, 107-1 can include one or more discrete light sources such as light emitting diodes (LEDs), optical elements (e.g., lenses, diffusers, reflectors, etc.), control circuitry, power, etc. In some embodiments, light from both primary optical subsystem 106-1 and secondary optical subsystem 107-1 can be distributed into architectural space 150 from the same cavity within wall 115. Moreover, photometric distributions from a primary optical subsystem 106 and a secondary optical subsystem 107 can, but do not have to, overlap, as discussed further below.

Figure 1B:
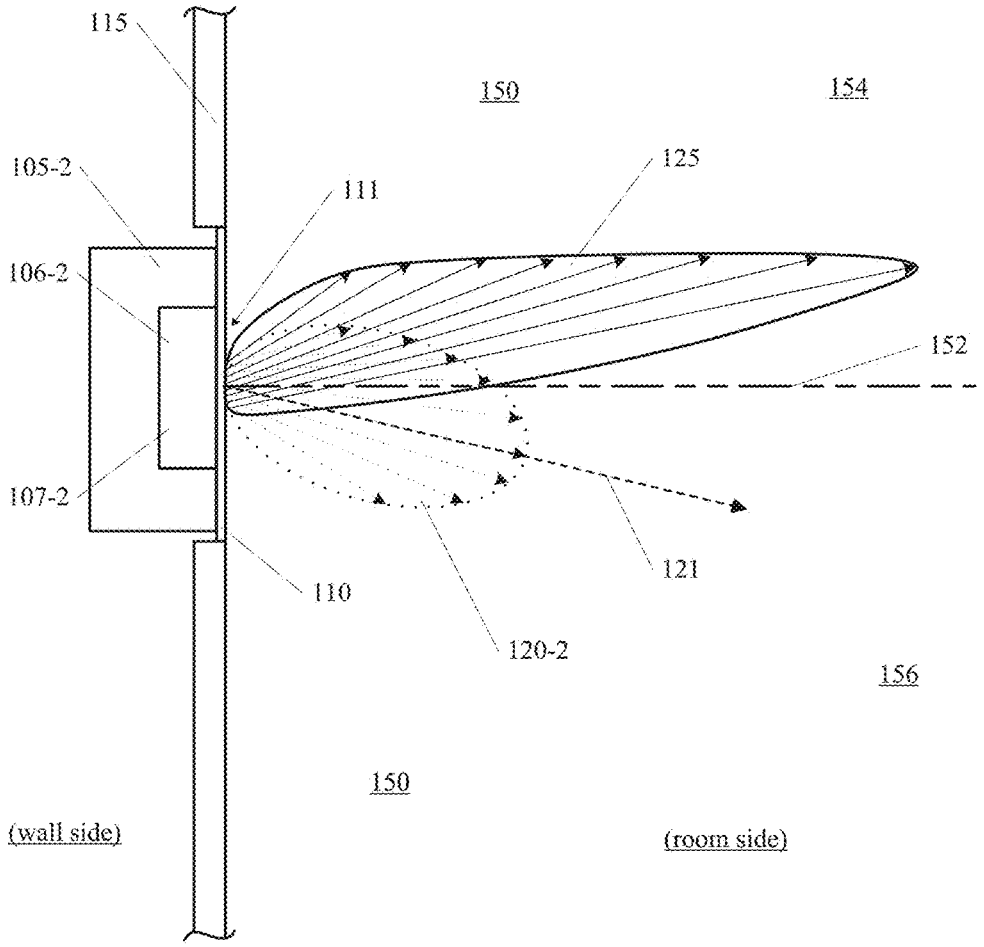
FIG. 1B schematically shows a photometric distribution from a primary optical subsystem and a secondary optical subsystem of a wall recessed two-component luminaire according to some embodiments of the invention.

Primary photometric distribution 125 is a far field photometric distribution of light from primary optical subsystem 106-1 within luminaire 105-1. Arrows at varying angles within distribution 125 illustrate strength of emitted light in the angle shown by each arrow. The characterization of photometric distribution 125 as a far field distribution means for example that light forming the distribution could be emitted at various locations of luminaire 105-1, but the distribution indicates where the light is directed. That is, distribution 125 indicates directionality of the light at a distance of perhaps twice or more of the size of luminaire 105-1. In some embodiments herein, reference will be made to an "output aperture" as a region of a luminaire that emits light, whether the light emits through a physical aperture or through a transparent or translucent element. That is, the term "output aperture" may be used whether or not such aperture is a physical aperture. A far field photometric distribution of light from an optical subsystem therefore means the light distribution at a distance, regardless of the point(s) of origin of the light. For example, if emitted light emits across an output aperture that spans direct and indirect lighting regions, the light may be characterized as having a far field photometric distribution that is solely within the indirect lighting region if all of the light is emitted towards the indirect lighting region (as shown in FIGS. 1A, 1B and discussed in other examples below).

As shown in FIG. 1A, primary photometric distribution 125 is directional relative to luminaire 105-1 so that the light indirectly illuminates architectural space 150. For example, primary optical subsystem 106-1 can cast some of the light across a ceiling. As another example, the majority of the light can be directed above horizontal (e.g., above the luminaire when disposed within a wall); for example, more than 70%, 75%, 80%, 85%, 90%, 95%, or 100% of the light from a primary optical subsystem 106 can be directed above horizontal. Photometric distribution 125 illustrates desirably strong light at angles just above horizontal; that is, strong light will be cast into architectural space 150 at an angle where it may intersect a surface far from a primary optical subsystem 106, promoting uniform illumination of architectural space 150 by reflected light. In embodiments, 50% or more of light characterized by far field photometric distribution 125 is directed at angles of 0 degrees to 15 degrees above horizontal, and in other embodiments, 50% or more of light characterized by far field photometric distribution 125 is directed at angles of 0 degrees to 25 degrees above horizontal.

The sense of upward and downward shown in FIG. 1A can also be reversed; that is, in embodiments primary photometric distribution 125 may be directed below horizontal, for example to illuminate a floor. For this reason, regions of an architectural space 150 illuminated by embodiments herein may be characterized as an indirect region and a direct region, with the specific upward or downward position of the indirect and direct regions depending on the specific lighting application. An indirect region is generally bounded by a scattering or reflective surface such that light impinging thereon lights the architectural space after it reflects, while a direct region is where an occupant's or observer's eyes will be located, such that the occupant or observer directly views light emitted by a luminaire into the direct region.

In some embodiments, the components that make up primary optical subsystem 106-1 (e.g., LEDs, lenses, heat sinks, etc.) are generally not viewable by an occupant of the architectural space. This allows for lighting characteristics of primary optical subsystem 106-1 to be arranged and/or optimized separately from lighting characteristics of secondary optical subsystem 107-1, for practical and aesthetic purposes. In some embodiments, the far field photometric distribution of a primary optical subsystem 106 can ensure that this is so, and in certain of these embodiments, primary optical subsystem 106 is positioned so as to be hidden from a viewer or occupant within a direct lighting region. To illustrate this concept, FIG. 1A shows architectural space 150 divided into two spaces by plane 152 shown as a broken line, it being understood that the plane 152 extends inwardly and outwardly from the page. Plane 152 divides architectural space 150 into an indirect lighting region 154, and a direct lighting region 156. In embodiments herein, indirect lighting region 154 is targeted for at least indirect illumination, and direct lighting region 156 is targeted solely for direct illumination, by a single luminaire. Direct lighting region 156 may be the only part of architectural space 150 that occupants will be located in; indirect lighting region 154 is a region of architectural space 150 that is for example close to a ceiling such that primary photometric distribution 125 is not visible by occupants of architectural space 150. Therefore, photometric distributions 125 and 120 may be independently tailored such that primary optical subsystem 106-1 provides indirect light as most of the task lighting for architectural space 150, but secondary optical subsystem

107-1 provides direct light that occupants of the architectural space see directly at the source of the light.

Secondary photometric distribution 120 is an example of the photometric distribution of light from secondary optical subsystem 107-1 within luminaire 105-1. In some embodiments, light from a secondary optical subsystem 107 can uniformly fill an architectural space. For example, secondary photometric distribution 120 may be substantially Lambertian, as suggested by the distribution shown in FIG. 1A.

In some embodiments, some crossover between the two photometric distributions 125, 120 may occur. For example, in some embodiments, a secondary optical subsystem 107 emits a significant percentage of its light in both upward and downward directions. In some embodiments, the combined photometric distribution can be primarily on one side or the other of horizontal. For example, more than 75%, 80%, 85%, 90%, 95%, or 100% of the combined photometric distributions can be directed on one side or the other of horizontal.

FIG. 1B schematically shows a block diagram example of a photometric distribution from a primary optical subsystem 106-2 and a secondary optical subsystem 107-2 that are colocated within a luminaire 105-2, according to some embodiments of the invention. The block showing primary optical subsystem 106-2 and secondary optical subsystem 107-2 is a functional block diagrams only and may not represent actual position of such elements in embodiments. Luminaire 105-2 is shown recessed within wall 115 behind front optical element 110. Each optical subsystem 106-2, 107-2 can include one or more discrete light sources such as light emitting diodes (LEDs), optical elements (e.g., lenses, diffusers, reflectors, etc.), control circuitry, power, etc. In the embodiment shown in FIG. 1B, light from both primary optical subsystem 106-2 and secondary optical subsystem 107-2 is distributed into architectural space 150 from a common output aperture 111. Moreover, some overlap between the photometric distribution from a primary optical subsystem 106 and a secondary optical subsystem 107 can, but does not have to, occur, as discussed further below.

In some embodiments, most of the light provided by a secondary optical subsystem is directed horizontally and/or downwardly. For example, in some embodiments, more than 50%, 55%, 60%, 65%, 70%, 75%, 80%, 85%, 90%, 95%, or 100% of the light can be directed at or below horizontal. In other embodiments, the secondary optical subsystem can direct light with a largely uniform distribution. In FIG. 1B, photometric distribution 120 is shown in dotted lines for clarity of illustration. In the embodiment shown in FIG. 1B, a maximum light intensity characterized by photometric distribution 120 is oriented downwardly, as shown by axis 121, although like the distributions shown in FIG. 1A, substantial overlap exists between photometric distributions 120 and 125.

A primary optical subsystem 106-2 can provide light with a number of different characteristics in addition to the photometric distribution. In some embodiments, a primary optical subsystem 106 can provide light with more luminous flux than the secondary optical subsystem. In other embodiments, a primary optical subsystem 106 can provide mostly white light for task lighting of an architectural space. For instance, a primary optical subsystem 106 can provide light with various spectral characteristics similar to various white light sources that are commonly available. Primary optical subsystem 106 can provide light that varies in time according to, or suggestive of, various environmental conditions such as, for example, the time of day, the day of the year, etc. Primary optical subsystem 106 can include a plurality of LEDs of various colors and/or white LEDs of various color temperatures. Primary optical subsystem 106 can also include an optical element that distributes the light according to the photometric distribution shown in FIGS. 1A, 1B.

A secondary optical subsystem 107 can also provide light with a number of different characteristics in addition to the photometric distribution. In some embodiments, a secondary optical subsystem 107 provides light with less luminous flux than a primary optical subsystem 106. In other embodiments, secondary optical subsystem 107 can provide light that is substantially distributed such that the light is occupant observed and/or side viewed. In other embodiments, the secondary optical subsystem can provide light of various colors, brightness gradients, and/or effects. In some embodiments, the secondary optical subsystem can provide light with a specific or user specified ambiance; for example, with various mood or thematic colors, or to be suggestive of natural light or a view of the sky, etc. Because, in embodiments, secondary photometric distribution 120 distributes light directly into an entire architectural space, while primary photometric distribution distributes light into only an indirect region of the architectural space, the light provided by a primary optical subsystem 106 can be thought of as task lighting while the light provided by a secondary optical subsystem 107 can be thought of as accent lighting. In embodiments, a secondary optical subsystem 107 includes light sources of red, green and blue (RGB) colors that can be independently controlled to generate various colors of light, or white light. In other embodiments, a primary optical subsystem can include white light sources and a secondary optical subsystem can also include white light sources (or may generate white light with RGB light sources), so as to generate a "white on white" color scheme with indirect and direct light.

In yet other embodiments, primary and/or secondary optical subsystems 106, 107 can provide light that varies according to any number of conditions such as, for example, the time of day, the day of the year, the season, the geographic location, the local weather conditions, user input, presence detection, music being played in the architectural space, etc. In some embodiments, a secondary optical subsystem 107 provides various luminance and/or chromatic gradients across the output aperture of the wall recessed luminaire as viewed by a user. In some embodiments, both the primary optical subsystem and the secondary optical subsystem can provide various luminance and/or chromatic gradients in conjunction with one another. For example, to simulate the passage of a cloud across the output aperture, the primary optical subsystem can provide less light and/or different colors while the secondary optical subsystem can provide a different color scheme.

As noted above, in various embodiments, primary optical subsystem 106 and secondary optical subsystem 107 provide light with a number of different characteristics. In some embodiments, a primary optical subsystem 106 is tailored to illuminate architectural space 150 with light having characteristics that are different than the characteristics of light provided by secondary optical subsystem 107.

In some embodiments, a primary optical subsystem 106 can direct light upwardly to indirectly illuminate architectural space 150 (e.g., by reflecting from a ceiling) and secondary optical subsystem 107 can direct light horizontally and/or downwardly in a diffuse manner to directly illuminate architectural space 150. These upward/downward relationships can be reversed in embodiments that provide indirect light directed towards a floor and accent light directed from a luminaire to a viewer. Moreover, a primary optical subsystem 106 can illuminate architectural space 150 with more light (e.g., provide light with more lumens and/or energy). In some embodiments, primary optical subsystem 106 can contribute more than 50% of the total light output of luminaire 105. In some embodiments, the primary optical subsystem can provide over 70%, 75%, 80%, 85%, 90% or 95% of the total light output of luminaire 105-2. And, in some embodiments, a primary optical subsystem 106 illuminates architectural space 150 with primarily white light, while a secondary optical subsystem 107 illuminates architectural space 150 with light having more color than primary optical subsystem 106. In some embodiments, a primary optical subsystem 106 may partially illuminate the architectural space downward or horizontal.

In some embodiments, secondary optical subsystem 107 provides light with qualities that are suggestive of natural light or a view of the sky through a window, portal, or translucent architectural element (e.g., glass block). In still further embodiments, secondary optical subsystem 107 may produce an illusion of depth or a perception of ambiguous depth within the output aperture when viewed by an occupant of the architectural space. Moreover, a secondary optical subsystem 107 can provide a lit appearance, direct view color and/or color gradients, direct view luminance and/or luminous gradients, and/or lighting for ambience.

In some embodiments, the color, brightness and/or distribution provided by a secondary optical subsystem 107 and/or a primary optical subsystem 106 can change over time. These changes can occur based on a program executed by a controller coupled with the light sources that modifies the lighting parameters over time.

In some embodiments, a program can operate to control the lighting parameters of a number of luminaires in use together. Moreover, any number of programs can be used. For example, a program can control operation of optical subsystems to simulate daylight. Moreover, the program can change the light parameters throughout the day to simulate the sun passing through the sky. Such a program, for example, can vary based on the geographic location of the luminaire in use. As another example, a program can operate optical subsystems to simulate one or more clouds passing by. Any number of sky and/or weather patterns can be used. In some embodiments, the program can include sunset and sunrise simulations.

In some embodiments, a program can operate a luminaire to change its color presentation over time. This can include, for example, changing various color patterns within the full spectrum of color or changing the saturation of a given color or the brightness. In some embodiments, a program can operate to change colors across an array of luminaires. In this way, different luminaires can provide different color at different times. Moreover, the saturation of a color can change over time within one luminaire or across multiple luminaires. The brightness can also change across multiple luminaires.

In some embodiments, a program can change dynamically over time or in response to certain inputs. These inputs can include time of day, flipping of a switch, proximity detection, temperature, humidity, cloud conditions, time of year, etc.

In some embodiments, the vertical and/or horizontal luminous presentation (or light gradient) of the luminaire can change over time. This can include changing any number of characteristics of the light, such as the brightness, color, hue, saturation, etc. across the luminaire. This can also include changing a color profile vertically and/or horizontally across the luminaire. This can be accomplished, for example, by varying the characteristics of the top and bottom LEDs differently over time and/or varying the characteristics of left and right LEDs differently over time.

As discussed above, reference may be made to an "output aperture" whether or not such aperture is a physical aperture. For example, in FIGS. 1A and 1B, front optical element 110 includes one or more panes of glass or other transmissive, translucent, or transparent material (e.g., plastic, Plexiglas, etc.) at the output aperture. In some embodiments, front optical element 110 can include multiple layers, materials or elements, and/or may have properties related to the reflection, refraction, scattering, or diffusion of light. In some embodiments, front optical element 110 can cover the entire front of a luminaire 105. In other embodiments, front optical element 110 can include multiple panes that cover portions of the aperture within wall 115. In some embodiments, front optical element 110 can be translucent or hazy; can include glazing that provides the look of a transom window, clerestory and/or glass block; and/or can include an optical filter that allows light to pass with wavelengths that simulate the spectral profile (color) or brightness of daylight. And in yet other embodiments of the invention, front optical element 110 may be omitted.

Figure 2:
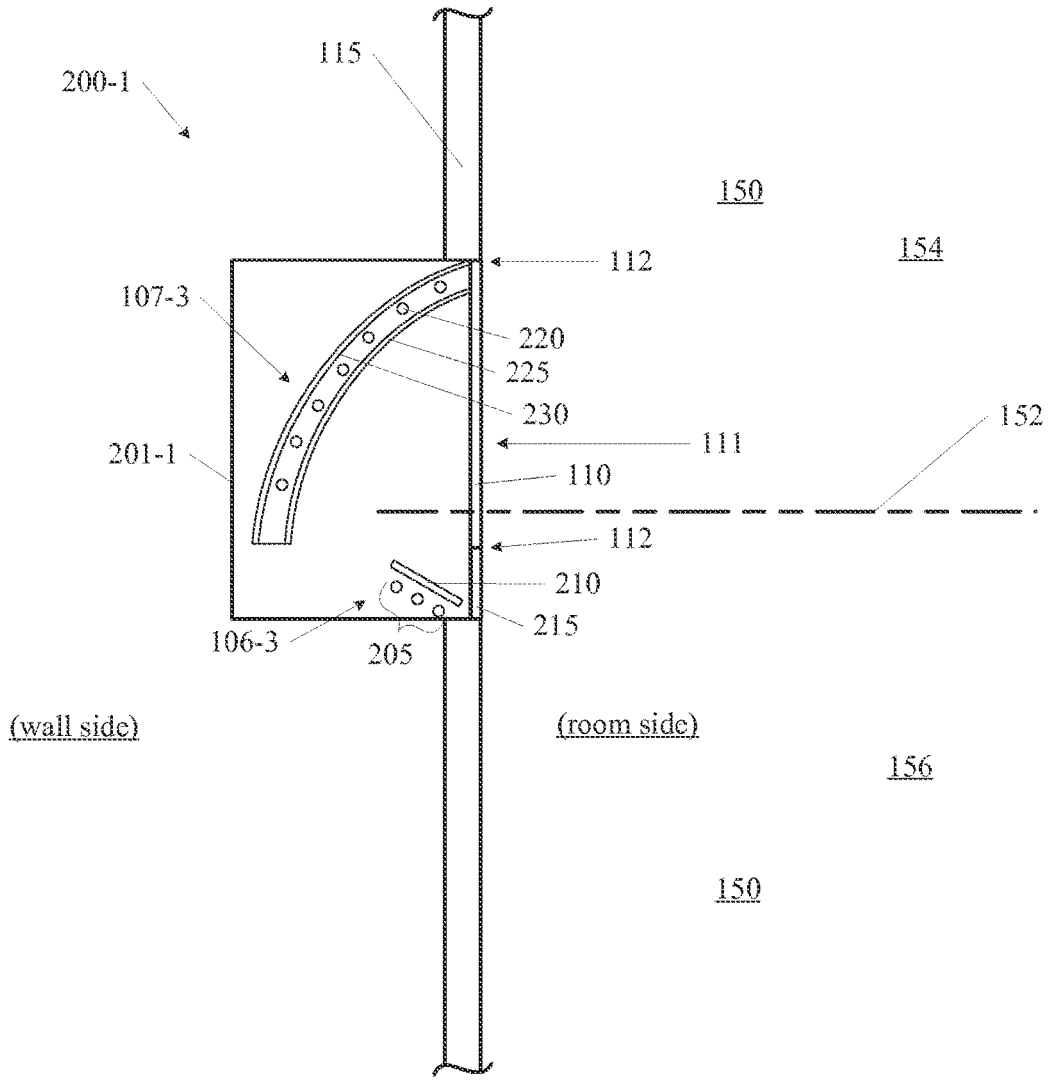
FIG. 2 schematically shows a cross section of a backlit, wall recessed luminaire according to some embodiments of the invention.

FIG. 2 schematically shows a cross section of a luminaire 200-1 according to some embodiments of the invention. In this embodiment, a primary optical subsystem 106-3 includes a plurality of LEDs 205 and an optical element 210 disposed within a luminaire housing 201-1. Peripheral edges 112 of housing 201-1 form an output aperture 111; a primary optical subsystem 106-3 is disposed within the housing so as to be hidden from a direct lighting region 156 by a panel section 215 that is bounded by at least one segment of peripheral edge 112. Optical element 210 can focus, direct, and/or control the dispersion, direction and/or angle of the light from the LEDs. For example, optical element 210 can direct light emitted from LEDs 205 upwardly (e.g., toward the ceiling) within architectural space 150.

In this embodiment, secondary optical subsystem 107-3 is a backlit arrangement that includes a plurality of LEDs 220, a reflective back surface 230, and a translucent optical element 225 disposed within luminaire housing 201-1. Translucent optical element 225 may or may not be curved along either or both a vertical or horizontal profile, and may for example be concave with respect to an output aperture 111, as shown. LEDs 220 illuminate architectural space 150 through translucent optical element 225. Translucent optical element 225 can include a diffuser; one or more layers, materials or elements; and/or can have properties related to reflection, refraction, scattering, or diffusion of light. For example, in some embodiments, translucent optical element 225 is a translucent film. Some light emitted from LEDs 220 can be directed toward translucent optical element 225. The light is diffusely scattered, and/or directed outwardly into architectural space 150 by translucent optical element 225. Other light emitted from LEDs 220 can be reflected from reflective back surface 230 and diffusely scattered, and/or directed horizontally and/or downwardly into architectural space 150 by translucent optical element 225. LEDs 205 and/or LEDs 220 can include a plurality of LEDs (or other light sources, such as an OLED panel or sheet in place of LEDs 220, either with or without reflective back surface 230 or translucent optical element 225) disposed horizontally along the length of the luminaire wall (into the page). In embodiments, LEDs 220 may also be of different colors than one another, and may be independently controllable such that vertical and/or horizontal gradients of color and/or intensity may be emitted by luminaire 200-1. In particular, LEDs 220 may include RGB LEDs such that any color, or white, may be utilized in gradients of color emitted by luminaire 200-1.

In some embodiments, light from both a primary optical subsystem 106-3 and a secondary optical subsystem 107-3 illuminate architectural space 150 from a common cavity within wall 115 and/or through front optical element 110. In other embodiments, the luminaire may not include a front optical element 110. In embodiments, a panel section 215 adjoining an edge segment of output aperture 111 is positioned to block the view of the interior of the luminaire, including at least primary optical subsystem 106-3, and optionally secondary optical subsystem 107-3. Panel section 215 can be positioned near the bottom of the output aperture within which the luminaire is placed to hide the interior of luminaire 200-1 from direct lighting region 156, and/or can comprise opaque material. Panel section 215 can have a finish similar to the rest of wall 115, and/or be finished with wall 115 to provide a seamless appearance.

Figure 3:
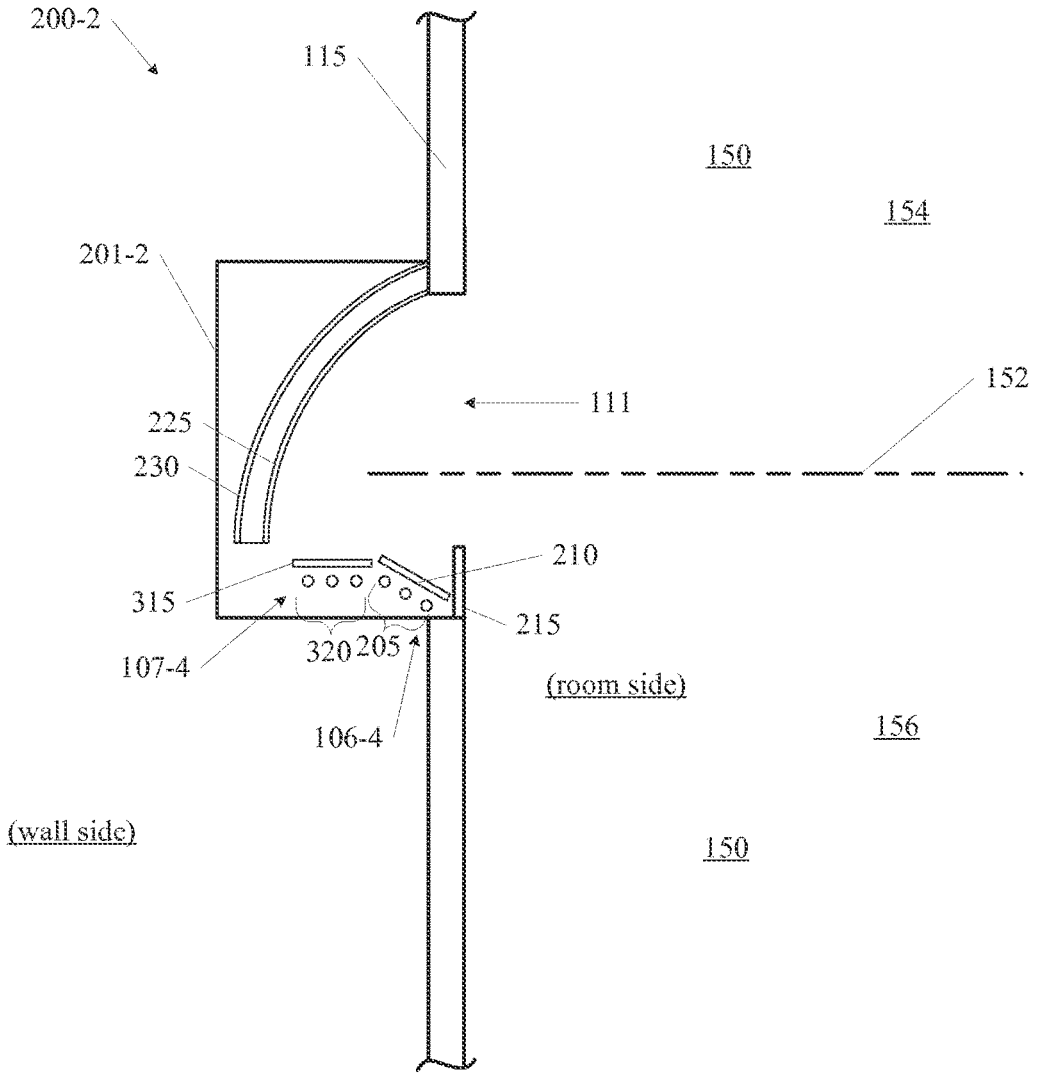
FIG. 3 schematically shows a cross section of a wall recessed luminaire according to some embodiments of the invention.

FIG. 3 schematically shows a cross section of luminaire 200-2 according to some embodiments of the invention. Luminaire 200-2 can fit within a single cavity in wall 115. In embodiments, primary optical subsystem 106-4 can include a plurality of LEDs 205 and optical element 210 arranged to illuminate the ceiling of the architectural space. For example, optical element 210 can direct light emitted from LEDs 205 into indirect lighting region 154 (e.g., upwardly) within architectural space 150. In this embodiment, there is no front optical element such that output aperture 111 is an actual opening within luminaire 200-2. Light from primary and secondary optical subsystems 106-4, 107-4 exits luminaire 200-2 through output aperture 111. Output aperture 111 can represent any number of configurations that allow light from primary optical subsystem 106-4 and secondary optical subsystem 107-4 to exit the housing and pass through wall 115. Output aperture 111 can include any opening within the luminaire housing and the wall through which the light from primary and secondary optical subsystems 106-4, 107-4 exits luminaire 200-2.

Secondary optical subsystem 107-4 can include a front-lit arrangement that includes a plurality of LEDs 320, reflective back surface 230, and/or translucent optical element 225. In some embodiments, only reflective back surface 230 is used. Moreover, various other reflective, translucent, or other surfaces and/or materials can be used. Furthermore, in embodiments, reflective back surface 230 can be specular and/or diffusing. Most of the light emitted from LEDs 320 is directed toward translucent optical element 225 and/or reflective back surface 230 by optical element 315. Some of the light can then be reflected into architectural space 150 from translucent optical element 225, while other light can pass through translucent optical element 225 and be reflected off reflective back surface 230, and directed into architectural space 150 through translucent optical element 225. Either or both reflective back surface 230 and translucent optical element 225 can be shaped to direct light downwardly and/or horizontally into architectural space 150. For example, reflective back surface 230 and/or translucent optical element 225 can be shaped and/or angled in various ways to control the direction of the light, have particular color or luminance gradients, and/or have optical properties that achieve this directionality. Optical element 315 can focus, control, diffuse, and/or direct light toward reflective back surface 230 and translucent optical element 225.

LEDs 205 and/or LEDs 220 can include a plurality of LEDs (or other light sources) disposed horizontally along the length of the luminaire wall (into the page).

Figure 4:
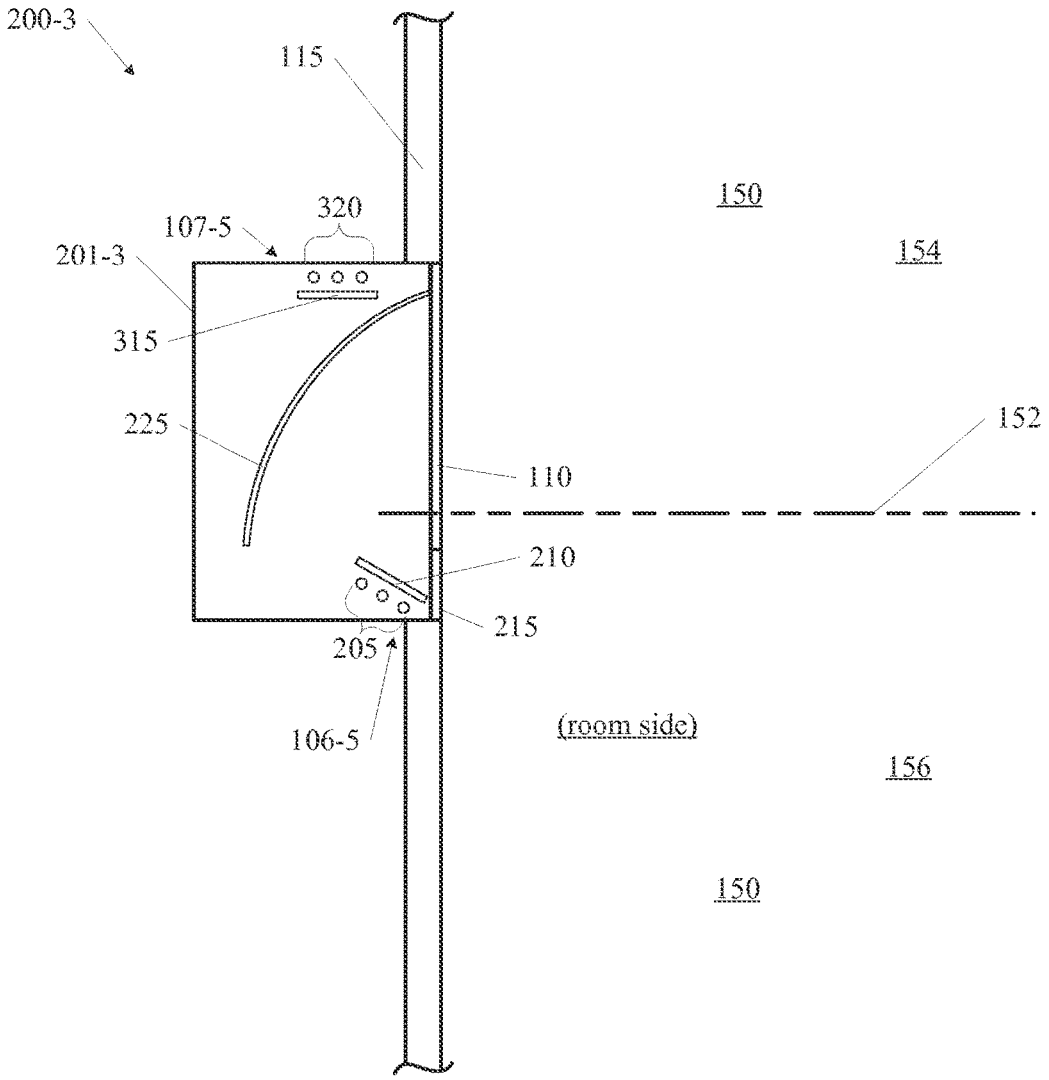
FIG. 4 schematically shows a cross section of a wall recessed luminaire according to some embodiments of the invention.

FIG. 4 schematically shows a cross section of luminaire 200-3 according to some embodiments of the invention. Luminaire components are disposed within luminaire housing 201-3. In this embodiment, secondary optical subsystem 107-5 is moved behind translucent optical element 225. In embodiments, a reflective back surface (like 230) can be included elsewhere within luminaire 200-3. In other embodiments, reflective back surface 230 is not used in luminaire 200-3.

Figure 5:
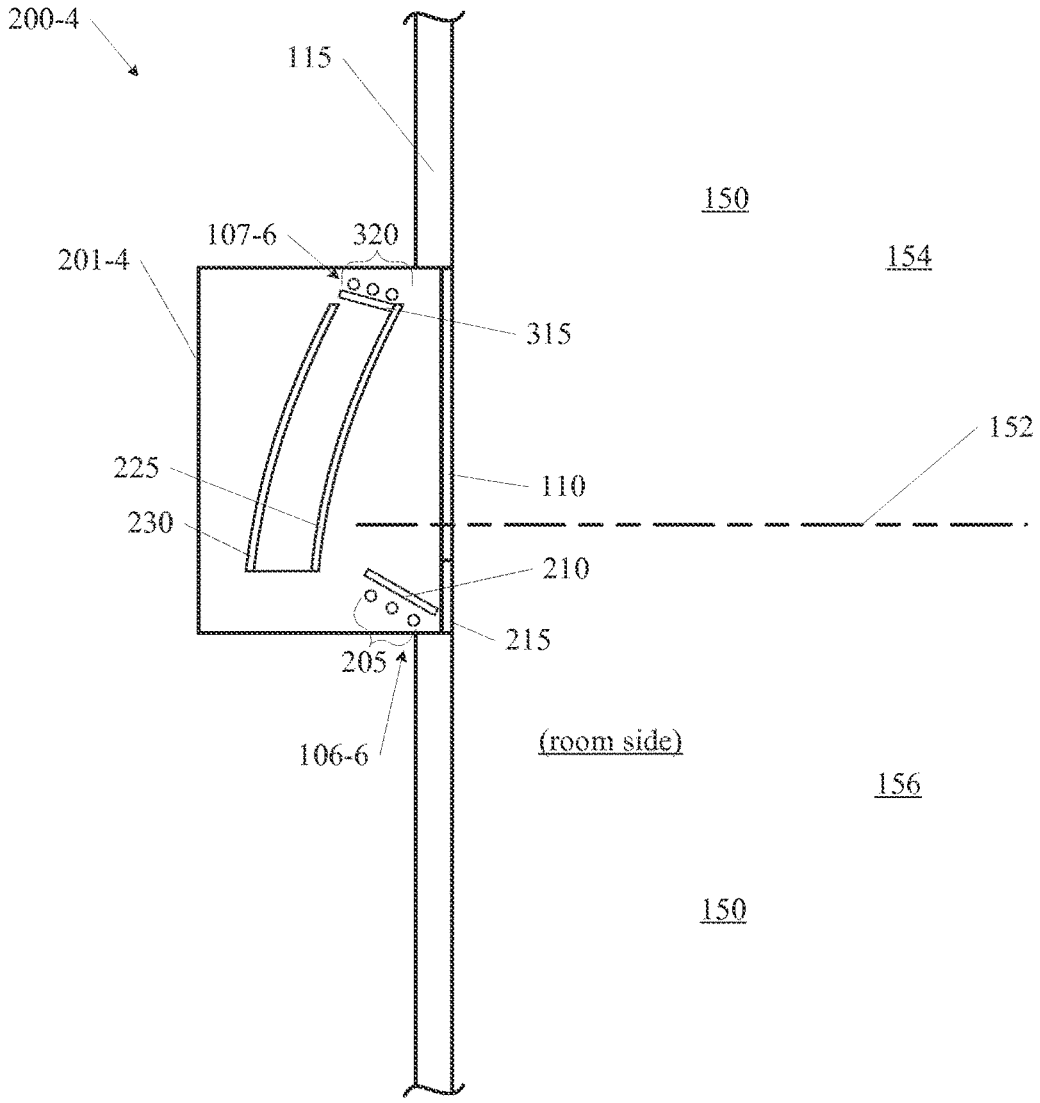
FIG. 5 schematically shows a cross section of a wall recessed luminaire according to some embodiments of the invention.

FIG. 5 schematically shows a cross section of luminaire 200-4 according to some embodiments of the invention. Luminaire components are disposed within a luminaire housing 201-4. In this embodiment, a secondary optical subsystem 107-6 is moved to provide light between a translucent optical element 225 and a reflective back surface 230.

Figure 6:
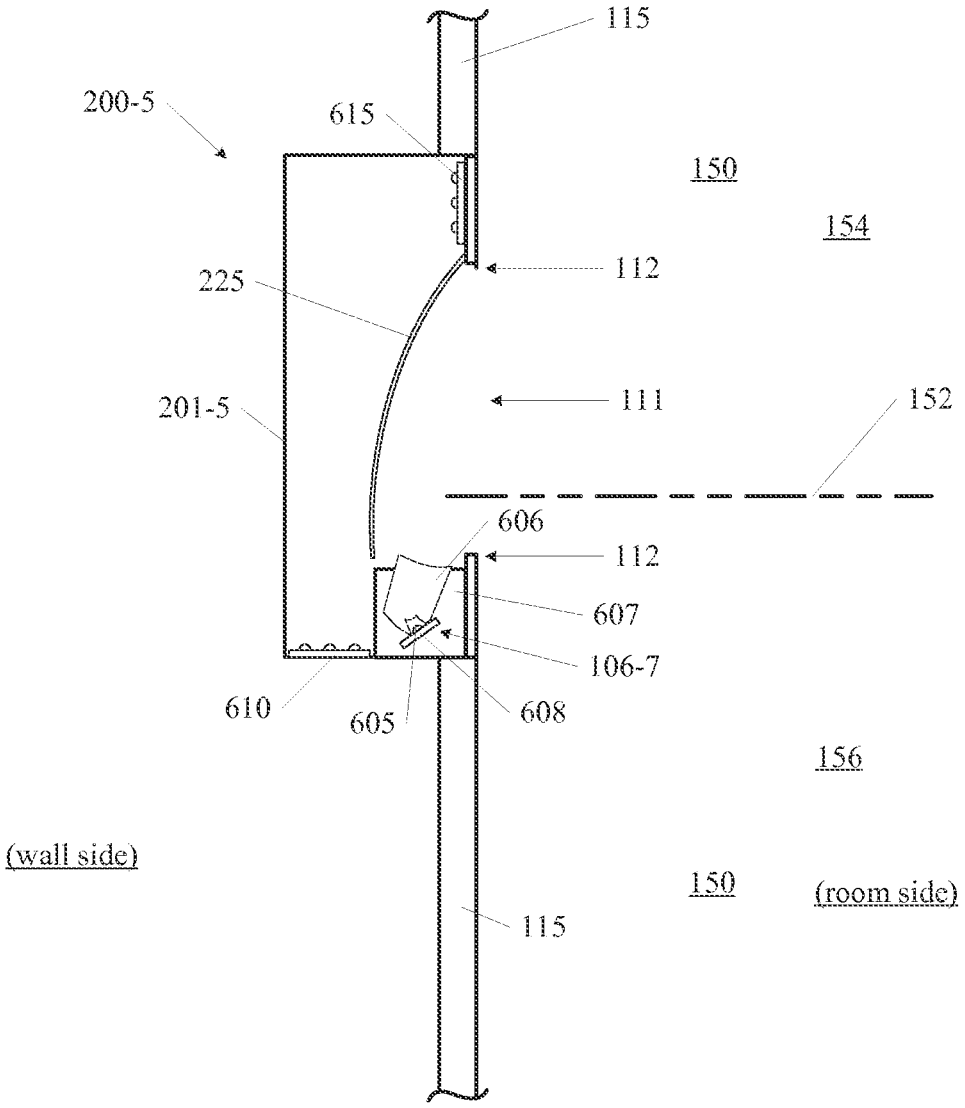
FIG. 6 schematically shows a cross section of a backlit wall recessed luminaire according to some embodiments of the invention.

FIG. 6 schematically shows a cross section of a luminaire 200-5 according to some embodiments of the invention. Luminaire components are disposed within luminaire housing 201-5. Peripheral edges 112 of housing 201-5 form an output aperture 111; a primary optical subsystem 106-7 is disposed within the housing so as to be hidden from direct lighting region 156 by a panel section 215 that is bounded by at least one segment of peripheral edge 112. In embodiments, a primary optical subsystem 106 can include a plurality of white or substantially white LEDs 605, circuit board 608, lens 606, and/or heat sink 607.

A secondary optical subsystem can include a number of secondary light sources. For instance, a secondary optical subsystem in FIG. 6 includes light sources 610 disposed above, light sources 615 disposed below, output aperture 111. Light sources 610 may be, for example, LEDs. Light sources 610 may also be positioned to direct light upwards behind translucent optical element 225. Light sources 610 and 615 may also include distributions of LEDs along the length of wall 115 in which luminaire 200-5 is mounted (e.g., into and out of the page with respect to FIG. 6). LEDs of such distributions may be independently controllable such that horizontal gradients of color and/or intensity may be produced.

Light sources 615 are positioned within the housing at a level above the top portion of output aperture 111 near a peripheral edge of output aperture 111 and can direct light inwardly toward the back surface of housing 201-5, which may be of, or coated with, a white or reflective material to act as a mixing chamber. The light from light sources 610 and 615 can mix within housing 201-5 prior to passing through translucent optical element 225 and exiting through output aperture 111. Such mixing can be complete, such that output aperture 111 appears to have a constant color and/or intensity across the aperture, or can be partial such that portions of output aperture 111 have color and/or intensity that is dominated by one set of light sources (610, 615) or the other. Further, light sources 610 and 615 may be independently controllable and arranged such that varying color and/or intensity patterns applied to light sources 610 and 615 result in corresponding gradients of color and/or intensity when viewed from direct lighting region 156. Light sources 615 and 610 can include a plurality of LEDs, for example, of one or more colors, depending on the application. In certain applications, it may be preferred to have light sources 615 and/or 610 be of a single color, to provide accent lighting of that color alone, with lower cost than for LEDs and a controller to provide RGB color and mixing capability.

Figure 10:
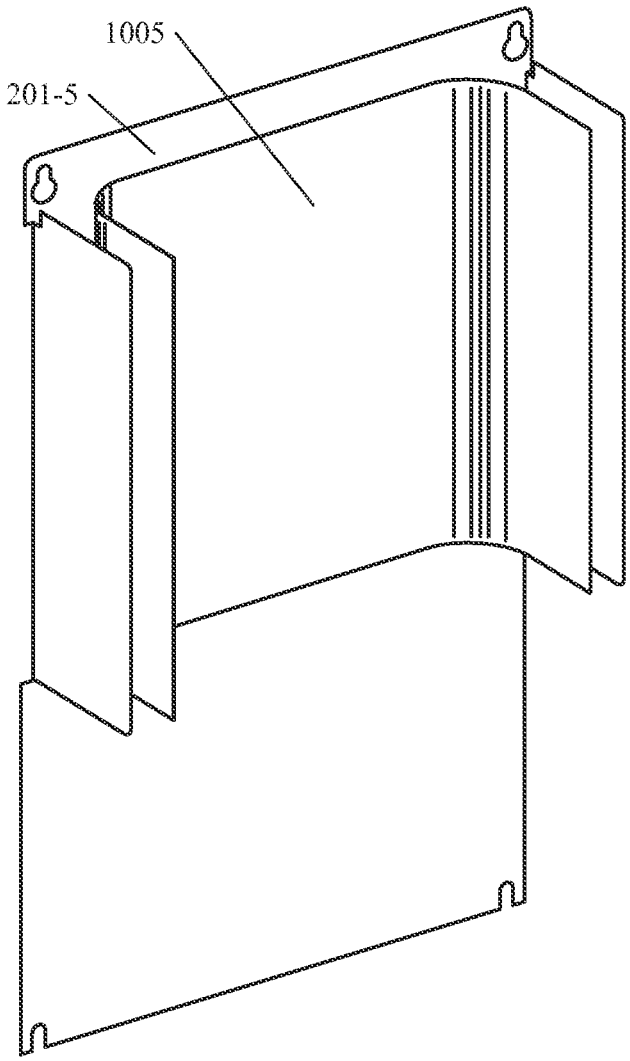
FIG. 10 schematically shows a back panel with a reflective insert according to some embodiments of the invention.

Luminaire 200-5 can also include a reflective back surface or reflective insert 1005 of housing 201-5, as shown in more detail in FIG. 10. This reflective back surface of housing 201 can be part of the luminaire body or an insert within the luminaire body. A reflective surface on the back of housing 201 can reflect light from light sources 610 and 615 toward translucent optical element 225. LEDs may also be positioned on the side of translucent optical element 225. In embodiments, housing 201 can be coated or made from any type of reflective material that allows the light from various secondary light source LEDs to mix within the body of luminaire 200-5 prior to passing through translucent optical element 225 and then exiting luminaire 200-5.

Certain applications may benefit from a mix of luminaire types. For example, a first type of luminaire might provide both task lighting as indirect light, and accent light as direct light, and a second type of luminaire might provide accent light capability that matches the capability of the first type, but does not include indirect lighting capability, in order to reduce cost. Thus, in embodiments, luminaire 200-5 may be provided in versions that are similar to one another, but with one version lacking primary optical subsystem 106-7 (that is, without LEDs 605, circuit board 608, lens 606, and/or heat sink 607).

Figure 7:
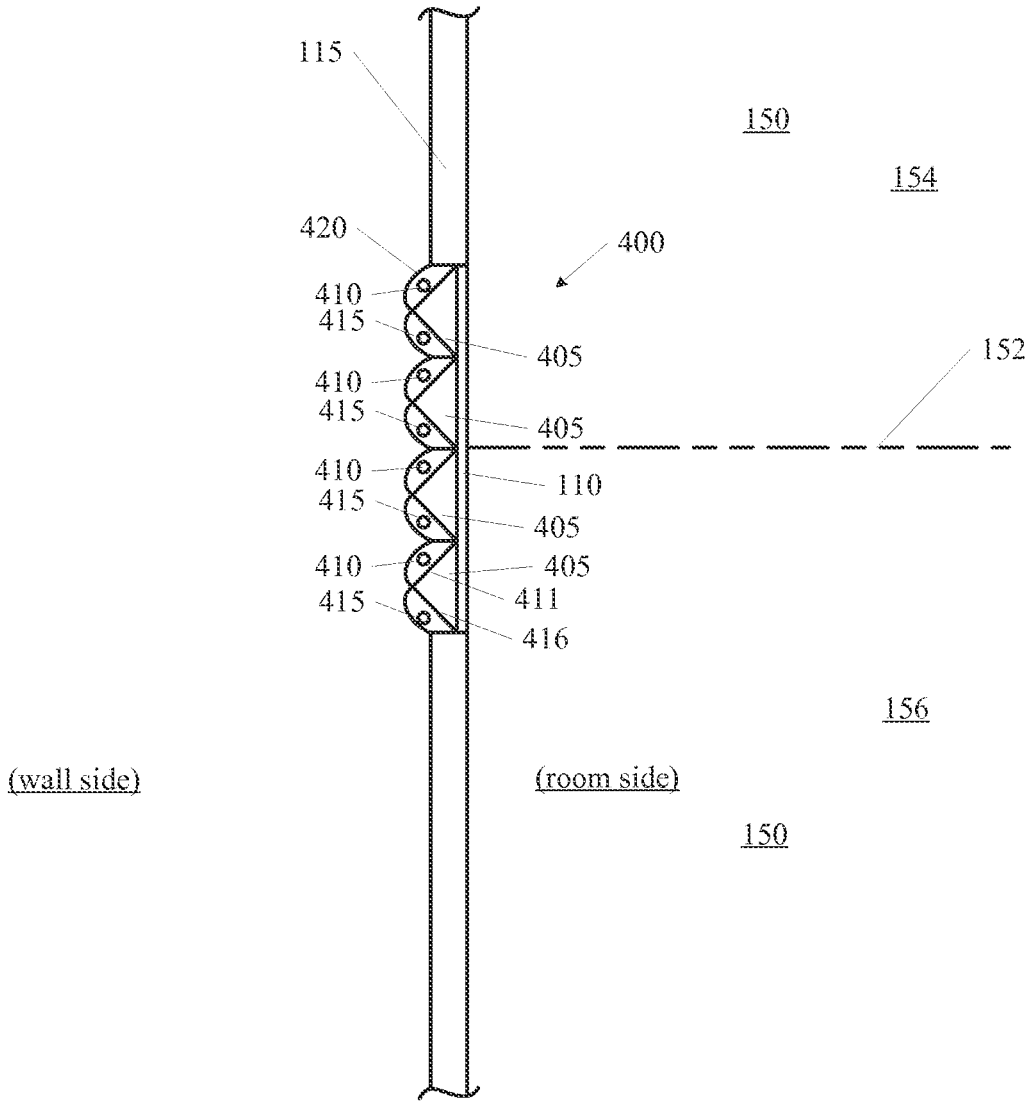
FIG. 7 schematically shows a cross section of a wall recessed luminaire according to some embodiments of the invention.

FIG. 7 schematically shows a cross section of a recessed luminaire 400 according to some embodiments of the invention. Recessed luminaire 400 can fit within a cavity located within wall 115. Recessed luminaire 400 can include a plurality of elongated prisms 405 that extend horizontally (into the page) and are disposed one on top of another vertically. Each prism 405 has a triangular cross section that can be equilateral, isosceles, and/or scalene. The prisms can vary in size, shape, dimension, angle and/or curvature. In embodiments, each prism 405 can be arranged relative to one another such that one of the surfaces of each prism 405 forms a plane with one of the surfaces of other prisms 405.

Primary optical subsystem LEDs 415 can be positioned behind each prism (opposite the architectural space 150) below the apex of prism 405. In this configuration, light from primary optical subsystem LEDs 415 will pass through prism 405 toward the ceiling as shown by primary photometric distribution 125 in FIGS. 1A, 1B. The direction, size, and/or shape of the photometric distribution from primary optical subsystem LEDs 415 through prism 405 can vary depending on the shape of prisms 405.

Secondary optical subsystem LEDs 410 can be positioned behind each prism (opposite the architectural space 150) above the apex of prism 405. In this configuration, light from secondary optical subsystem LEDs 410 will pass through prism 405 downwardly and/or horizontally into the architectural space as shown by secondary photometric distribution 120 in FIGS. 1A, 1B. The direction, size, and/or shape of the photometric distribution from secondary optical subsystem LEDs 410 through prism 405 can vary depending on the shape of prisms 405.

In embodiments, prisms 405 can be shaped to change the photometric distribution of light. For example, surface 416 of the prisms 405 nearest LEDs 415 can be shorter than surface 411 nearest LEDs 410. In this configuration, light from LEDs 415 can be directed upwardly at a steeper angle and light from LEDs 410 can be directed more horizontally. In embodiments, the curvature of the prism faces can be changed to change the direction of the light. Various other sizes, dimensions, and/or angles can be used to change the direction, and/or angle of the light from LEDs 410 and 415. In embodiments, the various prisms can have different shapes in order to provide a varied photometric distribution.

In embodiments, front optical element 110 may not be used or it may be part of prisms 405. While four elongated prisms are shown, any number of prisms may be used. In embodiments, reflective cover 420 can surround secondary optical subsystem LEDs 410 and/or primary optical subsystem LEDs 415 and reflect light into prisms 405.

Moreover, while each prism is shown associated with a single primary optical subsystem LED 415 and a single secondary optical subsystem LED 410, in some embodiments, multiple prisms can be associated with a primary optical subsystem and/or a secondary optical subsystem. In other embodiments, a single prism can be associated with a plurality of light sources. And, in some embodiments, secondary optical subsystem LEDs 410 and/or primary optical subsystem LEDs 415 can represent a plurality of light sources arranged horizontally along the elongated prism. In embodiments, a diffuser (not shown) may be placed between secondary optical subsystem LEDs 410 and prisms 405 as well as between primary optical subsystem LEDs 415 and prisms 405. Such diffusers can spread the light across the prism to provide a horizontally uniform light presentation and/or mix colors from various light sources. In some embodiments, a diffuser can be placed between the prisms 405 and front optical element 110.

Figure 8:
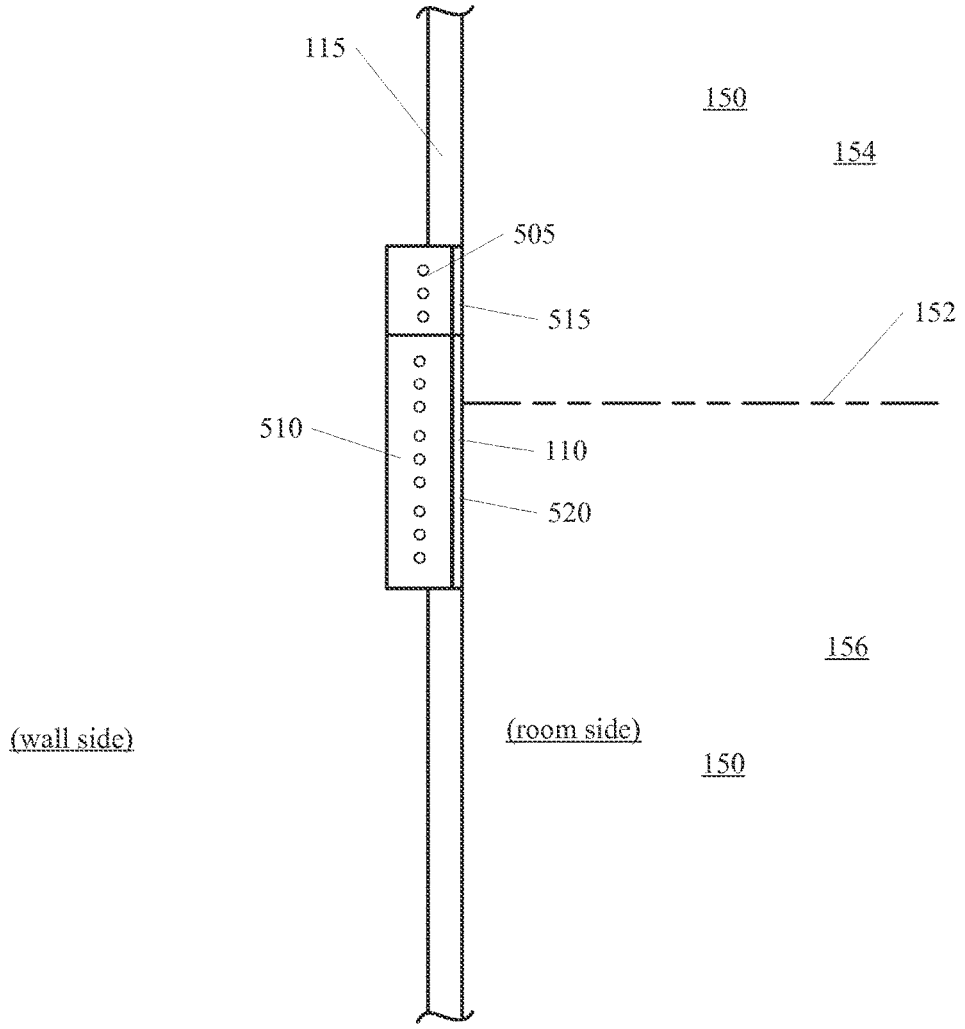
FIG. 8 schematically shows a cross section of a wall recessed luminaire according to some embodiments of the invention.

FIG. 8 schematically shows another embodiment of a wall recessed luminaire. In this embodiment, primary optical subsystem 505 can be located within wall 115 above secondary optical subsystem 510. Primary optical subsystem 505 can include a plurality of LEDs or other light sources. Primary optical subsystem 505 in conjunction with primary optical element 515 (e.g., lens, diffuser, etc.) can direct light toward the ceiling, for example, according to primary photometric distribution 125 of FIGS. 1A, 1B. Secondary optical subsystem 510 in conjunction with secondary optical element 520 (e.g., lens, diffuser, etc.) can direct light horizontally and/or downwardly, for example, according to secondary photometric distribution 120 of FIG. 1B. Secondary optical subsystem 510 can include, for example, any type of display panel(s) such as an LCD, OLED, LED matrix, or plasma display. In some embodiments, this wall recessed luminaire can include a plurality of LEDs. Various other geometric arrangements are possible. For example, the primary and/or secondary subsystems can be disposed in different locations in, on, and/or around output aperture 111.

Figure 9:
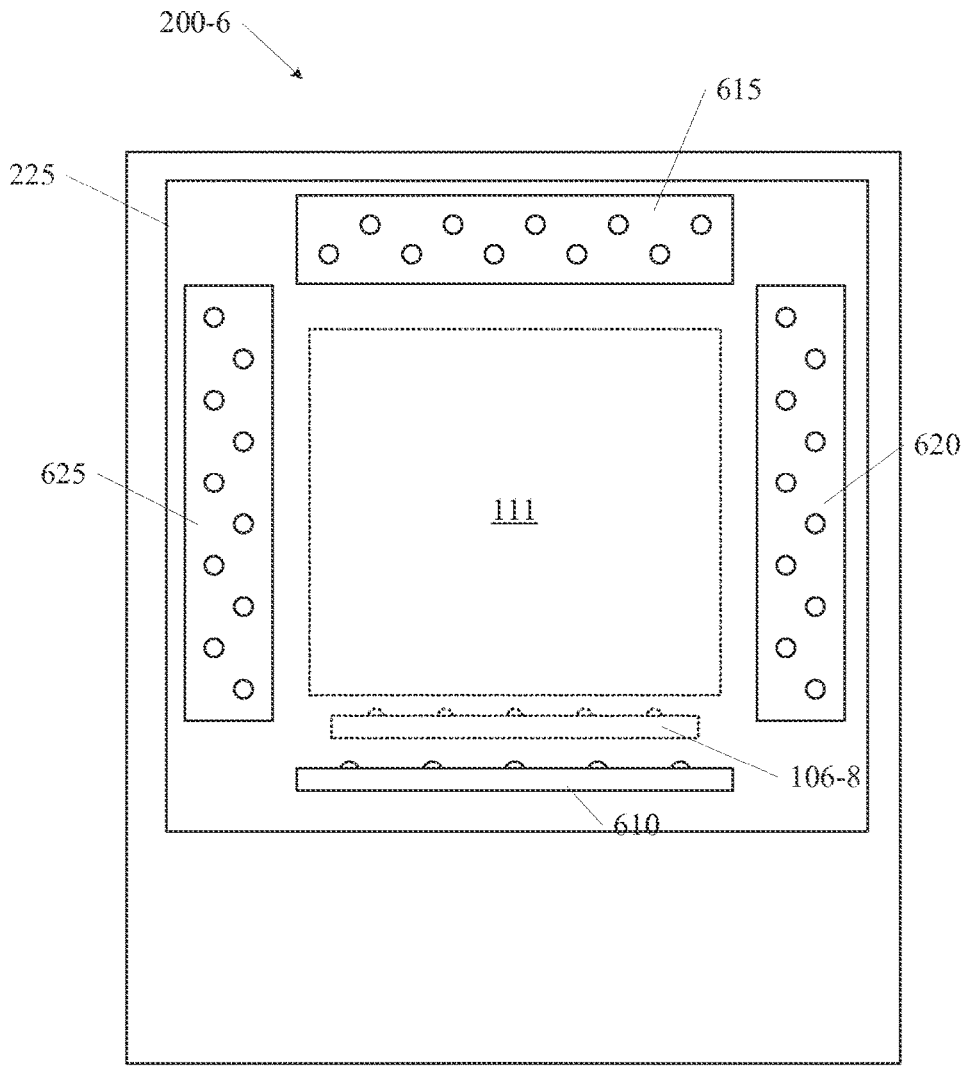
FIG. 9 schematically shows a back view of a luminaire according to some embodiments of the invention.

A back view of a luminaire 200-6 is schematically shown in FIG. 9. The view of FIG. 9 assumes that any rear housing wall has been removed, and shows luminaire 200-6 positioned about an aperture 111. A translucent optical element 225 is positioned such that light from light sources 610, 615, 620 and 625 pass through translucent optical element 225 prior to exiting the luminaire through output aperture 111. Light sources 610, 615, 620 and 625 may be, for example, RGB LED light sources capable of generating various colors and/or white light. A primary optical subsystem 106-8 is positioned in front of translucent optical element 225 (that is, toward aperture 111 in the view of FIG. 9, and behind translucent optical element 225. In this embodiment, the secondary optical subassembly includes the four light sources 610, 615, 620 and 625. Light sources 615 and 610 may be positioned, for example, as shown in FIG. 6. The secondary optical subsystem also includes light sources 620 and 625 positioned on the sides of translucent optical element 225. In embodiments, light sources 620 or 625 can be controlled to create a color and/or intensity gradient across translucent optical element 225 when viewed from the outside. For instance, LEDs on one side can provide light having one color and LEDs on the other side may provide light of another color. In this way, the presented illumination can vary horizontally across the luminaire. Similarly, light sources 615 and 610 can provide a corresponding effect in the vertical direction. Moreover, a combination of vertical and horizontal gradients can be provided. Light sources 610, 615, 620, and 625 can be independently controlled, and can therefore provide both vertical gradients of direct lighting as discussed in connection with FIG. 6, and horizontal gradients and/or combinations of vertical and horizontal gradients, to provide more sophisticated aesthetic direct lighting options.

The light sources that make up either or both primary or secondary optical subsystems 106, 107 can include LEDs of any type, color, size, etc. known in the art. Any configuration or arrangement of light sources can be used as shown in the various embodiments of the invention. The light sources can be disposed on a circuit board and may include optical elements such as a lens placed on or near the light sources on the circuit board as shown, for example, in FIGS. 15 and 16. Each of the secondary light sources can be independently controlled and/or operated to produce various effects.

FIG. 10 schematically shows a luminaire housing 201-5 and a reflective insert 1005 that are suitable for inclusion in luminaire 200-6, FIG. 9. Light sources 610, 615, 620, and 625 may produce light that is reflected off of the back panel of housing 201-5 or reflective insert 1005, shown in FIG. 10. Reflective insert 1005 can be made from any highly reflective material (e.g., White Optics™ 97). Reflective insert 1005 can also be made from a material that is diffusely reflective. The corners of reflective insert 1005 can have radii large enough to eliminate corner shadow.

In embodiments, the back surface and/or side surfaces of a housing 201 may be reflective, and in such embodiments, reflective insert 1005 may or may not be used. The reflective back surface and/or reflective side surfaces of housing 201 and/or reflective insert 1005 can produce a light mixing chamber within the body of the luminaire. Some light from secondary light sources can be mixed within the body of the chamber after being reflected off the back or side surfaces of housing 201 and/or reflective insert 1005 prior to exiting through a translucent optical element 225 (such as described in conjunction with the embodiment shown in FIG. 6). Some light can also exit the translucent optical element 225 without interaction with reflective back surface of a housing 201 and/or a reflective insert 1005.

Figure 11A:
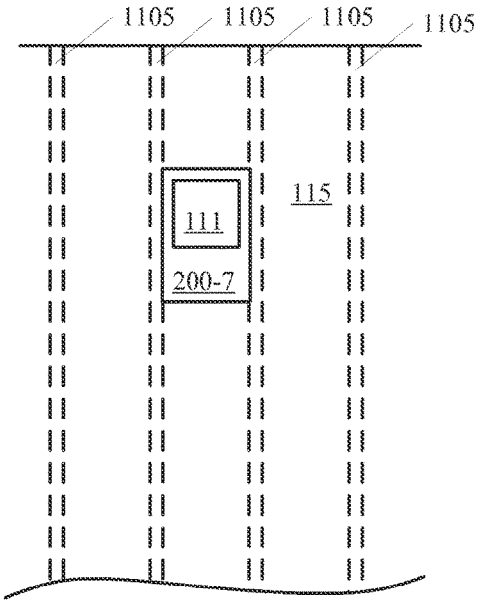
FIGS. 11A, 11B, 11C and 11D schematically show examples of a wall recessed luminaire according to various embodiments of the invention from a wall facing perspective.

FIGS. 11A through 11D schematically show luminaires 200-7 through 200-10 according to various embodiments of the invention from a wall facing perspective. In FIG. 11A, as shown, luminaire 200-7 can fit in between two studs 1105 (e.g., 2×4s or steel studs) within wall 115. Luminaire 200-7 can be recessed within the cavity in the wall between the two studs 1105. Output aperture 111 is where light exits the luminaire into the architectural space. Output aperture 111 can be any size. In some embodiments, output aperture 111 can be 6 inches by 6 inches.

Figure 11B:
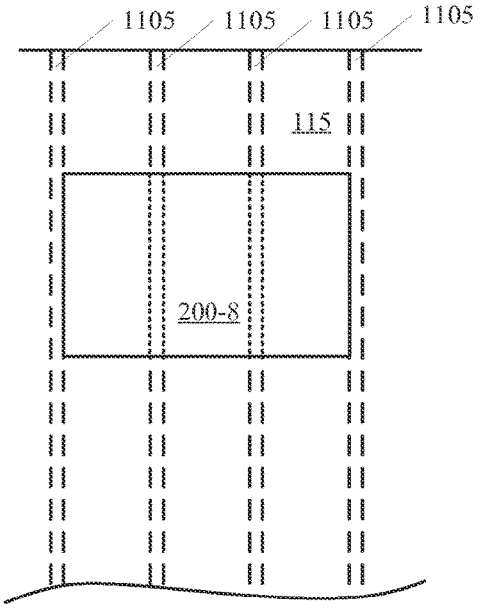

FIG. 11B shows luminaire 200-8 spanning multiple studs 1105. In some configurations, primary and/or secondary optical subsystems, light sources, controllers, optics, power, etc. shown in any of the embodiments may be separated into subsystems that are recessed within the wall between studs 1105. A common front optical element can span the various subsystems, providing a look and feel to the occupant of a single visual element.

Figure 11C:
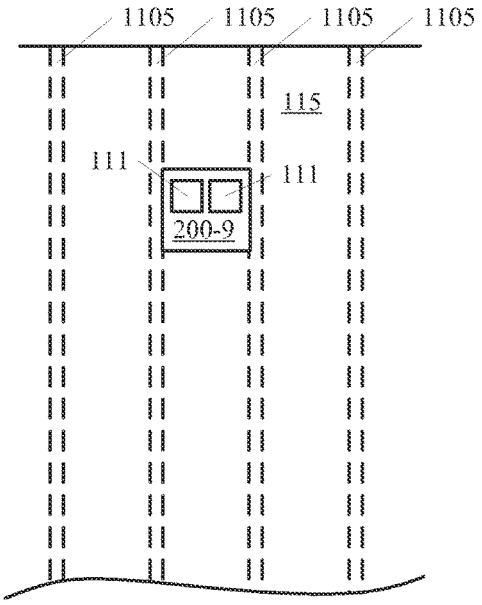

FIG. 11C shows a single luminaire 200-9 with two output apertures 111 according to some embodiments of the invention. Separate or the same primary and secondary optical subsystems can illuminate the architectural space through both output apertures. Luminaire 200-9 can fit between two studs 1105 within wall 115. Luminaire 200 can be recessed within the cavity in the wall between the two studs 1105. Output apertures 111 can include optical systems that provide separate illumination profiles yet both fit within studs 1105. Output apertures 111 can have any size that fits between studs 1105. In some embodiments, output apertures 111 can be 12 inches by 12 inches or 6 inches by 6 inches, and may be of the same size or may be of different sizes than one another. Common finishing elements (e.g., frames, moldings, optical elements and the like) can span the various subsystems and output apertures 111, providing a look and feel of a single visual element to occupants. Output apertures 111 of luminaire 200-9 need not have identical primary and secondary optical subassemblies; in particular, one output aperture 111 may be associated with a primary optical subassembly while the second output aperture 111 is not, but the two output apertures 111 may be associated with similar or identical secondary optical subassemblies. In this manner, indirect lighting for an architectural space may be provided from a single output aperture 111 to minimize cost, while direct lighting for the architectural space is provided from both output apertures 111 for aesthetic purposes.

Figure 11D:
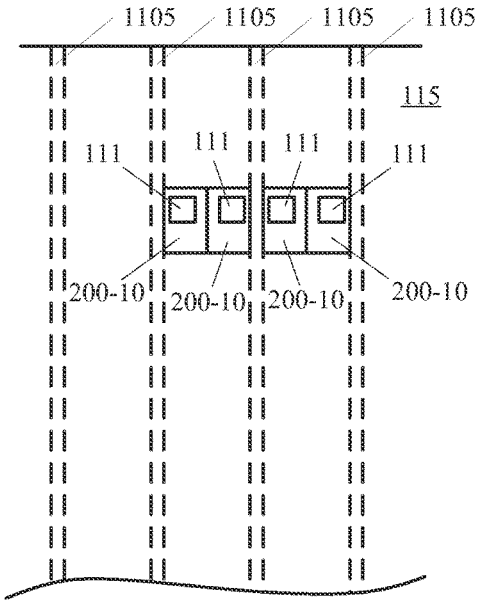

FIG. 11D shows four recessed luminaires 200-10 that each illuminate via one output aperture 111. Pairs of luminaires 200-10 fit together between two studs 1105 according to some embodiments of the invention. Each luminaire 200-10 includes a separate output aperture 111; output apertures 111 are offset within luminaires 200-10 so that a distance between adjacent output apertures 111 is constant across any two luminaires 200-10, even when adjacent luminaires 200-10 are separated by a stud 1105. In this manner, a row of output apertures 111 appears evenly spaced to provide the appearance of a continuous fixture despite the presence of intervening studs 1105. In some embodiments, output apertures 111 can be 6 inches by 6 inches, and luminaires 200-10 and output apertures 111 thereof may be of the same size or may be of different sizes than one another. Like luminaire 200-9 shown in FIG. 11C, common finishing elements (e.g., frames, moldings, optical elements and the like) can span luminaires 200-10, providing a look and feel of a single visual element to occupants. Also, similar to luminaire 200-9 shown in FIG. 11C, luminaires 200-10 need not have identical primary and secondary optical subassemblies; in particular, a subset of luminaires 200-10 may include primary optical subassemblies while other luminaires 200-10 do not, but the set of luminaires 200-10 may include similar or identical secondary optical subassemblies. In this manner, indirect lighting for an architectural space may be provided from a subset of luminaires 200-10 to minimize cost, while direct lighting for the architectural space is provided all of the luminaires 200-10 for aesthetic purposes.

In embodiments, custom wall framing may be used to impart a polished appearance to the installation. Custom wall framing members can extend horizontally above and below the housing(s) and can span multiple vertical studs, whether the studs are cut as in FIG. 11B or intervening between luminaires as in FIG. 11D.

Figure 12A:
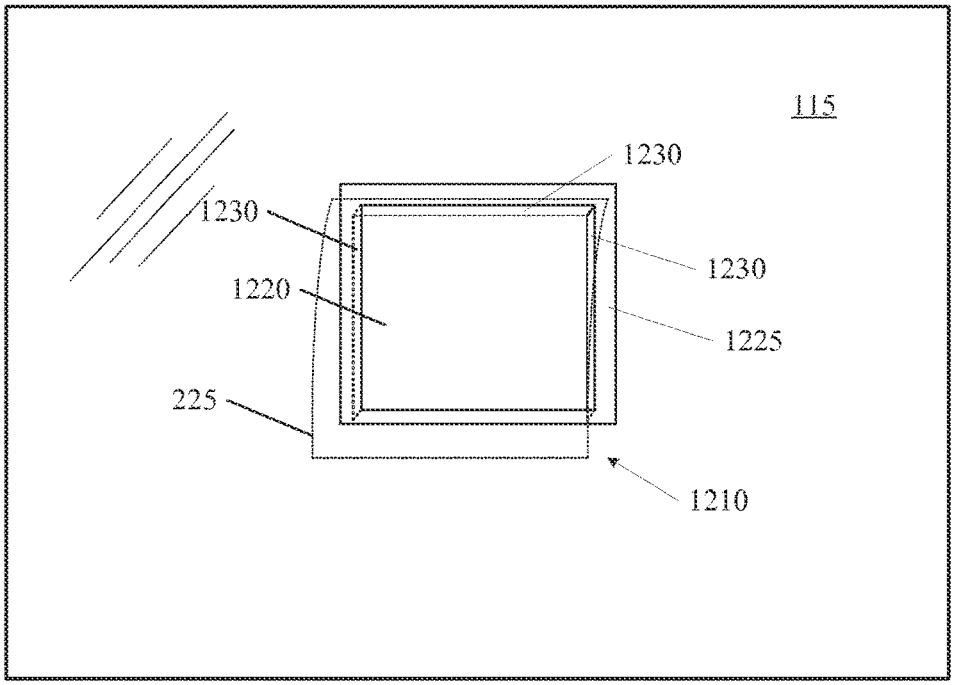
FIGS. 12A and 12B schematically show front views of wall recessed housing according to some embodiments of the invention.
Figure 12B:
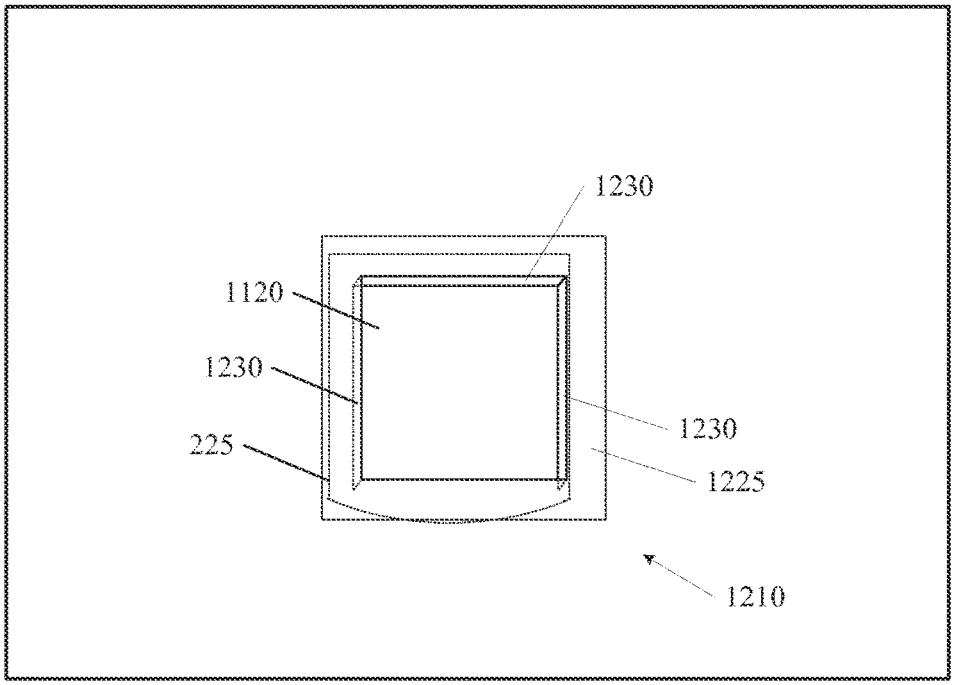

In embodiments, the installation may include a trim piece, such as a frame 1210 that defines a frame opening 1220. The frame can be of any shape or design, for example, including, but not limited to, shapes or designs that are standard for window trim or picture frames. The frame may be integrally-formed with the luminaire housing or, alternatively, may be a separate trim piece (see FIGS. 13 and 14) that couples to the luminaire housing (or other structure) to ensure that the frame opening 1220 aligns with a wall aperture so that light generated by the luminaire can exit through, or be visible within, the wall aperture. The thickness of the frame 1210 and the size of the frame opening 1220 can vary depending on the appearance desired for the installation. The frame 1210 may be positioned relative to the wall aperture so that the front face 1225 of the frame is flush with the wall, inset back from the wall or extends over the wall beyond a wall aperture. For example, in embodiments, the entirety of the frame 1210 is positioned within the wall aperture so that the front face 1225 of the frame 1210 is flush with the wall. The frame 1210 may have a contrasting appearance with the wall or may be finished to appear seamless with the wall. Alternatively, frame 1210 may have a thickness such that it extends along the wall beyond the wall aperture (thus giving the appearance of a picture frame or window). FIGS. 12A and 12B show front views of a luminaire housing according to some embodiments of the invention. In some embodiments, a luminaire can include frame 1210 that is flush with the wall and covers the perimeter of the wall-cavity that extends beyond the aperture. In other embodiments, frame 1210 extends over the wall and beyond the wall-cavity. Frame 1210, for example, can have thickness small enough and/or be made from a material that allows the wall and frame to have a finish or can be finished to appear seamless. A recessed luminaire can also include trim or a frame that is flush to the wall, inset from the wall or extends over the wall beyond the wall-cavity. The trim or frame can have any thickness and/or style. In some embodiments, the housing can include driver, power, and/or control logic.

In some embodiments, side surfaces 1230 (sometimes referred to herein as insets or sidewalls) can extend backwardly from the frame 1210 into the wall cavity and/or into a housing aperture. These side surfaces 1230 can frame portions of the wall aperture and/or luminaire output aperture 111. In embodiments, side surfaces 1230 can have a depth of 2.0, 1.75, 1.5, 1.25, 1.0, 0.75, 0.5, 0.25, etc. inches. The side surfaces 1230 can, but do not have to be, integrally formed with the frame 1210. These side surfaces 1230 can be finished to match the wall surface or have a clean architectural finish of their own. In some embodiments, depending on the location of various optical components, a wall recessed luminaire can include one, two, three, or four side surfaces 1230.

In one specific embodiment, three side surfaces 1230 are provided on the frame 1210, within the output aperture on the opposing sides and on the top of the frame. In some embodiments side surfaces 1230 provide depth to the installation (such as a window sill) and/or are used to shield from the view the internal components of the luminaire 200. In embodiments, frame 1210 can be integral with side surfaces 1230. In some embodiments, LEDs or other optical components can be integrated within frame 1210 and/or side surfaces 1230.

FIG. 12A schematically shows translucent optical element 225 having a vertical curve. FIG. 12B shows translucent optical element 225 having a horizontal curve. In yet other embodiments, translucent optical element 225 can have a curvature in both the vertical and horizontal directions. In embodiments, translucent optical element 225 can also have a vertical and/or horizontal tilt relative to some axis. As shown in the figures, translucent optical element 225 can extend internally within the housing beyond the edges of the sides surfaces 1230 that extend inwardly into a wall aperture and luminaire housing output aperture 111. In this way, the side surfaces 1230 can shield from view the edges of the translucent optical element 225 and the various components of both the primary optical subsystem and the secondary optical subsystem.

In embodiments, frame 1210 and/or side surfaces 1230 can be integral with the housing that is disposed within the wall. In other embodiments, frame 1210 and/or side surfaces 1230 can be part of separate outer inset that couples with the housing portion disposed within the wall. Such an inset is shown in FIG. 13.

In some embodiments, translucent optical element 225 can be collapsible, rollable, and/or flexible in order to be installed, replaced or removed through the aperture. In some embodiments, translucent optical element 225 may have slits, cuts, rivets, pegs, folds, flanges, wings, seams or gathers in order to provide the curvature and/or to fit within the housing. In embodiments, translucent optical element 225 can be positioned within the housing without being coupled directly with the housing. In other embodiments, translucent optical element 225 can be coupled within the interior of the housing. In some embodiments, translucent optical element 225 can extend past the internal edges of side surfaces 1230 and/or can terminate near internal edges of the housing.

Figure 13A:
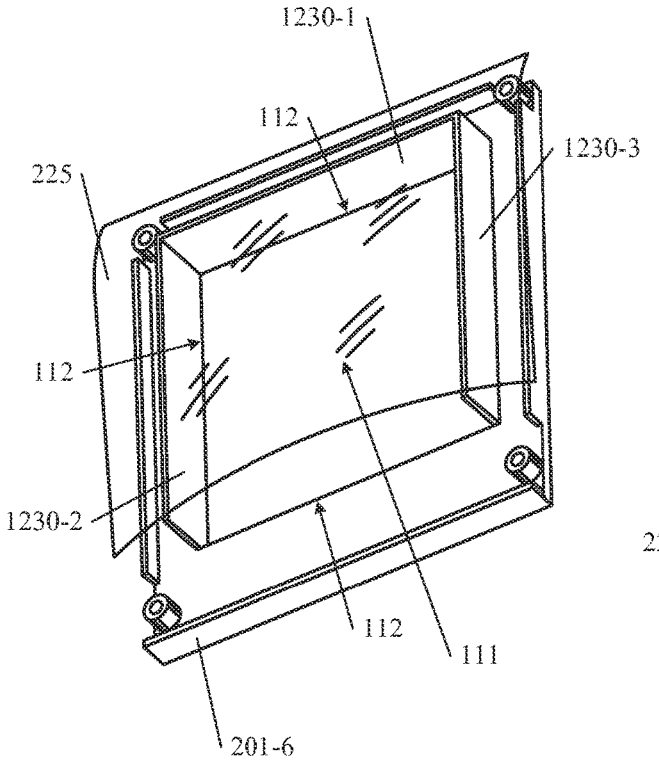
FIGS. 13A and 13B schematically show a translucent optical element placed over output aperture according to some embodiments of the invention.
Figure 13B:
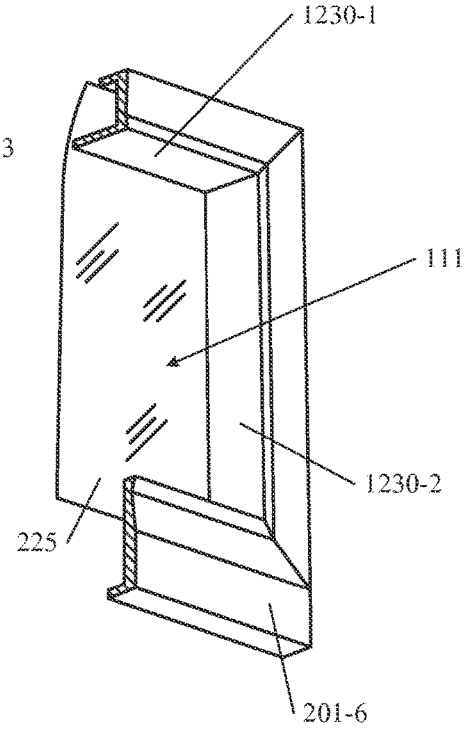

FIG. 13A schematically shows translucent optical element 225 placed over output aperture 111, viewed from behind a housing 201-6, while FIG. 13B shows translucent optical element 225 behind output aperture 111, viewed from in front of housing 201-6. Housing 201-6 is substantially rectangular, as shown, and segments of a peripheral edge 112 form output aperture 111. One segment of peripheral edge 112 is substantially horizontal when the luminaire is installed; a first sidewall 1230-1 adjoins this edge segment, as shown. Second and third sidewalls 1230-2 and 1230-3 adjoin vertical segments of edge 112, as also shown. Sidewalls 1230 extend perpendicularly into housing 201-6. In some embodiments, translucent optical element 225 can be positioned within a luminaire housing and may be positioned from the top of an output aperture 111 toward the bottom of the aperture, as shown in FIG. 6. Translucent optical element 225 may be positioned away from the bottom peripheral edge of output aperture 111 (or the interior facing housing surface) in order to provide space for primary optical subsystems that illuminate the architectural space without exiting through translucent optical element 225. This arrangement can result in translucent optical element 225 having a concave shape and/or tilt along a horizontal axis.

In embodiments, translucent optical element 225, for example, can be a translucent film. In some embodiments, a clear or diffuse covering (e.g., front optical element 110 shown in FIG. 1) can be used to cover output aperture 111.

Figure 14A:
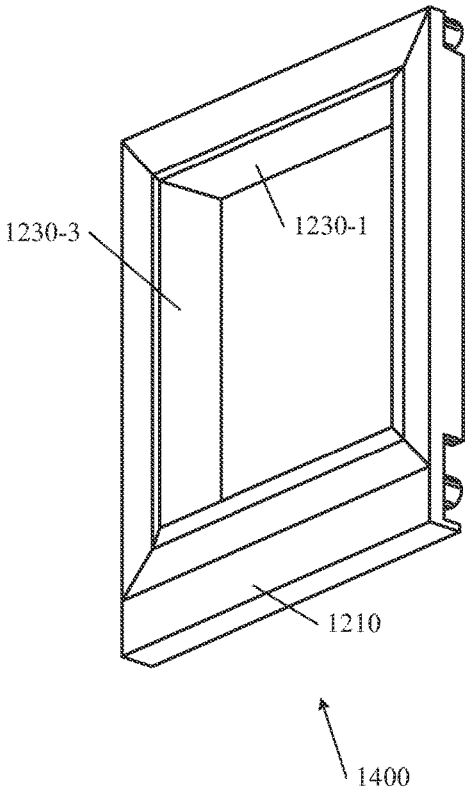
FIGS. 14A and 14B schematically show an inset that can be added to the room side of the wall and coupled with the functional components of a luminaire, according to an embodiment.
Figure 14B:
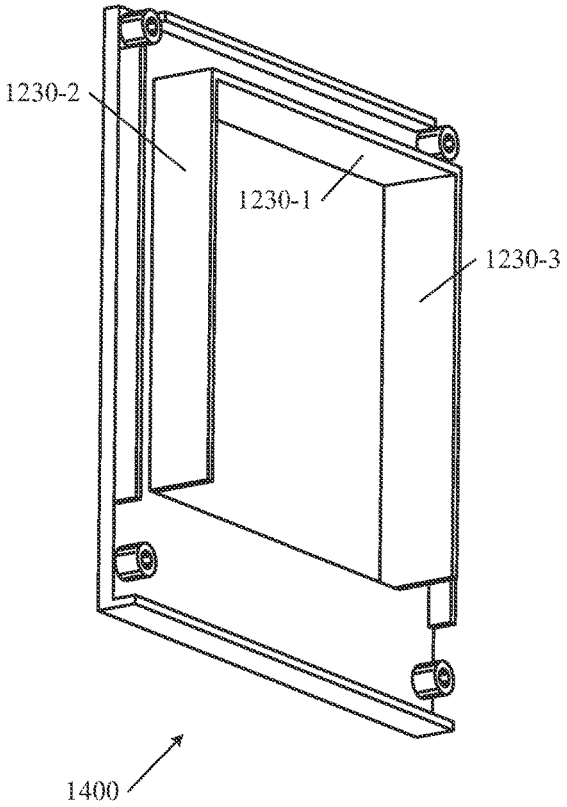

FIG. 14 schematically shows inset 1400 (or aperture trim piece) that can be added to the room side of the wall and coupled with the functional components of the luminaire disposed within a luminaire. Inset 1400 can be positioned on the wall (or any other surface) so that the front surface of inset 1400 is flush or substantially flush with the surface of the wall. In some embodiments, inset 1400 can be flush with the wall while side surfaces 1230 extend inwardly into the housing through the wall. In embodiments, inset 1400 can include side surfaces 1230 surrounding the top and sides of the output aperture and extending inwardly into the output aperture. Side surfaces 1230 can provide depth to the output aperture. In some embodiments, inset 1400 does not include a lower recessed side surface. As shown in the figure, frames 1210 can be slightly recessed in order to provide an area to form into the wall, for example, with plaster or mud to create an effect where inset is flush with the wall. Moreover, side surfaces can have a depth of 2, 1.75, 1.5, 1.25, 1.0, 0.75, or 0.5 inches extending from the front surface of inset into the housing. In this way, the front edges of output aperture 111 can be flush with the rest of the wall.

Some embodiments of the invention may not include inset 1400. In some embodiments, a frame can ring output aperture 111 on the external surface of the wall like a picture frame. In some embodiments the frame may not be flush with the wall. The frame can take on any shape or design, for example, including shapes or designs that are standard for window trim or picture frames. Moreover, the frame may include side surfaces that extend inwardly into the housing through the wall.

Figure 15A:
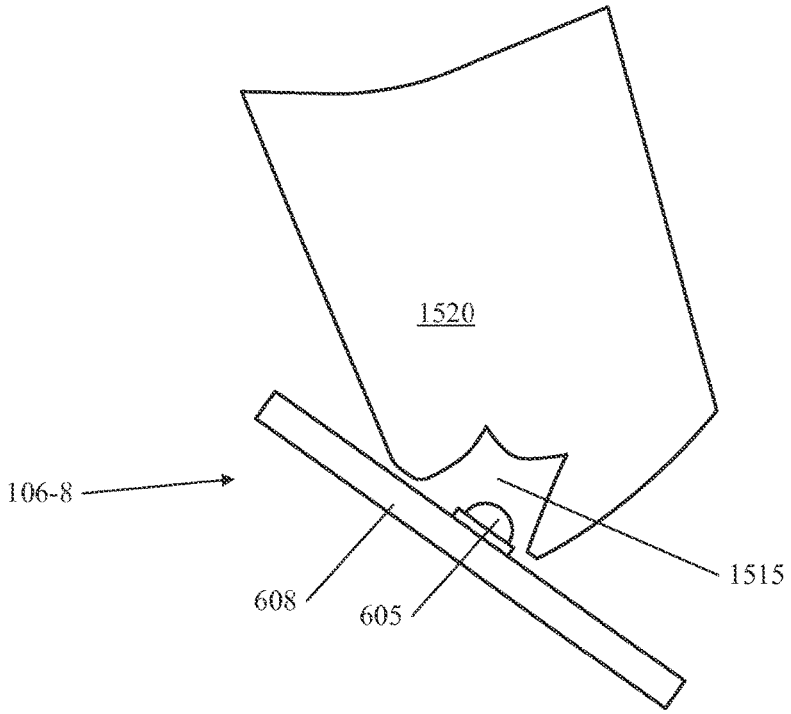
FIG. 15A schematically shows a side-view of a light emitting diode (LED) circuit board arranged with a lens according to some embodiments of the invention.

FIG. 15A schematically shows a side-view of an LED circuit board 608 arranged with lens 1520 according to some embodiments of the invention. LED circuit board 608 can include a plurality of LEDs 605 arranged in any geometric configuration on the circuit board 608. Any number of LEDs 605 can be arranged on the circuit board.

In embodiments, lens 1520 can be coupled with circuit board 608. Lens 1520 can project light in an upward illumination distribution using a combination of refraction and total internal reflection. Lens 1520 can be used with a primary optical subsystem 106-8, as shown. Lens 1520 includes pocket 1515 within which light sources 610 are placed. In some embodiments, lens 1520 is positioned a small distance away from circuit board 608. For example, an injection molded plastic piece can be positioned between circuit board 608 and lens 1520 in order to provide thermal isolation. In some embodiments, lens 1520 can be secured a distance away from circuit board 608 using brackets or other mechanical means in order to provide thermal isolation.

Figure 17:
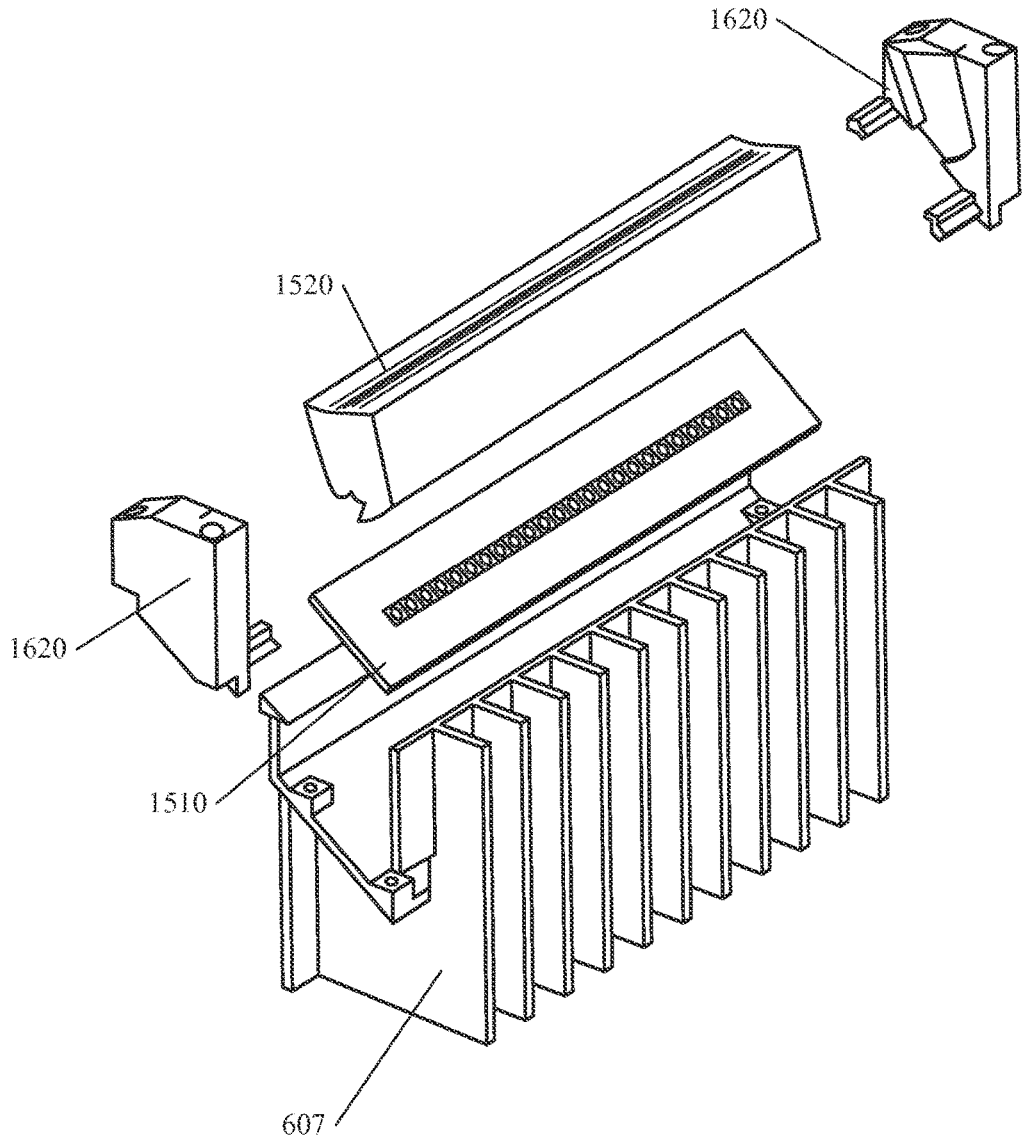
FIG. 17 schematically shows an exploded view of portions of primary optical subsystem according to some embodiments of the invention.

As shown in FIG. 17, the LEDs may not extend all the way across circuit board 608. This is done to reduce the amount of light that is incident on side surfaces (e.g., side surfaces 1230 shown in FIGS. 12A, 12B, 13A and 13B) of a recessed luminaire. In other embodiments, the LEDs can extend all the way along circuit board 608.

Figure 15B:
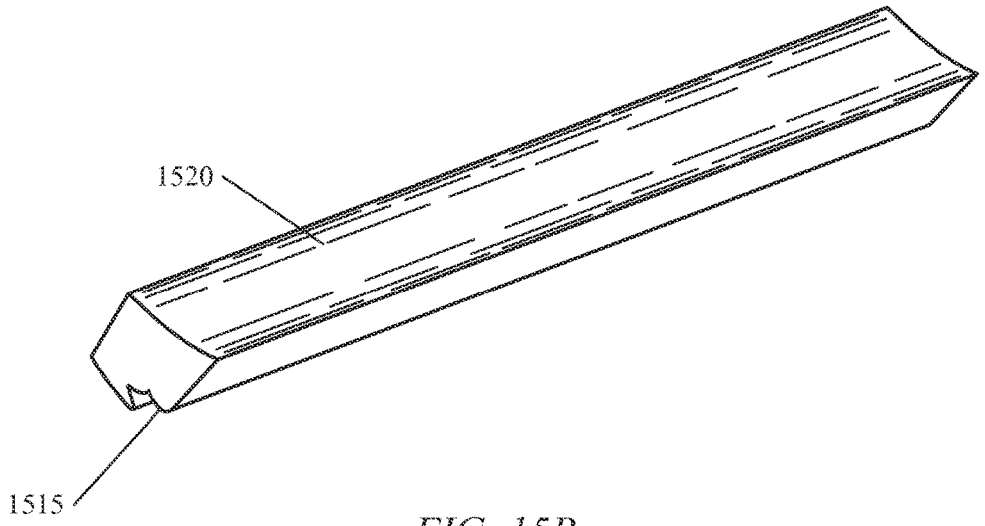
FIG. 15B schematically shows a three dimensional view of a total internal reflection (TIR) lens according to some embodiments of the invention.

FIG. 15B schematically shows a three dimensional view of lens 1520. Lens 1520, for example, can be made from extruded or injection molded plastic. Various other manufacturing techniques can be used to manufacture lens 1520. Lens 1520 includes pocket 1515 that extends along the length of lens 1520 and allows for a plurality of LEDs that are arranged along the length of the lens to be positioned within pocket 1515. A holder or bracket can be coupled with the ends of lens 1520 that can keep lens positioned away from circuit board 608. Moreover, the holder or bracket can be coupled with a heat sink. The holder or bracket can be screwed into the heat sink and also contain features to apply pressure to the LED board for maximum thermal contact between the LED board and the heat sink.

Figure 16:
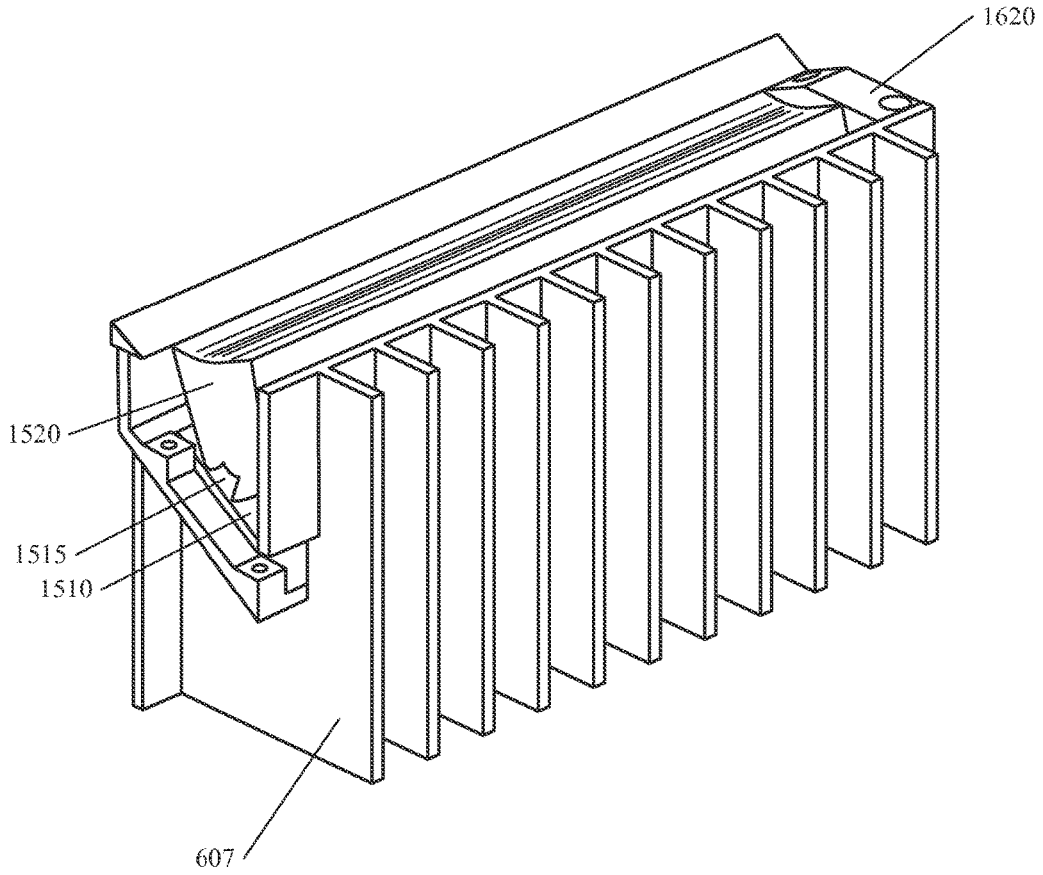
FIG. 16 schematically shows a lens and a circuit board positioned within a heat sink according to some embodiments of the invention.

FIG. 16 schematically shows lens 1520 and circuit board 608 positioned within heat sink 607. Heat sink 607 can conduct heat away from circuit board 608 and/or lens 1520. Heat sink 607 also acts as a holder for lens 1520 and circuit board 608. In this way, proper conductive contact is assured. Various other heat sink configurations can be used. Holders 1620 can be used to secure lens 1520 and circuit board 608 together and within heat sink 607.

FIG. 17 schematically shows an exploded view of portions of primary optical subsystem. Circuit board 608 includes LEDs arranged along the length of the board. Lens 1520 is positioned above circuit board 608. Holders 1620 coupled with the ends of circuit board 608 and lens 1520 can be used to keep some distance between circuit board 608 and lens 1520 and align LEDs to circuit board 608. Moreover, holders can be used to couple both circuit board 608 and lens 1520 with heat sink 607. Screws or bolts can be used to fasten holders 1620 with heat sink 607. As shown in the figure, holders 1620 have cutouts with the same cross-sectional shape as lens 1520.

Luminaires described herein can include any number of sizes, dimensions and/or configurations. For example, a luminaire housing can be less than 3.625 inches deep, in the in-wall direction. Luminaires can also have a width that is less than the standard commercial and/or residential stud width of 24 or 16 inches. That is, the width of the luminaire housing can be at or less than 22⅜ or 14⅜ inches.

In embodiments, the primary optical subsystem and/or the secondary optical subsystem (or components thereof) can be located anywhere within the output aperture. For example, primary optical subsystem and/or the secondary optical subsystem can be disposed on the sides, below, and/or above the output aperture as well as within the output aperture. Moreover, the secondary optical subsystem can include a plurality of secondary optical subsystems disposed in various locations and/or independently controllable in both spectrum and total output. For example, a first secondary optical subsystem can be disposed at the top of the output aperture that provides blue light, and a second secondary optical subsystem can be disposed at the bottom that provides red light. This example can provide a vertical gradient from red to blue.

While many luminaries have been described in a wall-recessed configuration, embodiments of the invention are not limited thereby. Luminaires described herein may be recessed in any surface such as a ceiling, counter, ground, or floor. For example, in a ceiling configuration, the secondary optical subsystem may provide a light distribution representative of a skylight. In some configurations, the primary optical subsystem can provide indirect light on a wall. And in some configurations, a plurality of primary optical subsystems can exist and may provide indirect light on one or more walls.

In some embodiments, the primary optical subsystem can be used to provide a floor wash. For example, the luminaire system can be positioned near a floor with the secondary optical subsystem providing various illumination conditions and the primary optical subsystem illuminating the floor. Such a luminaire can be used for step or night lighting solutions.

Figure 18:
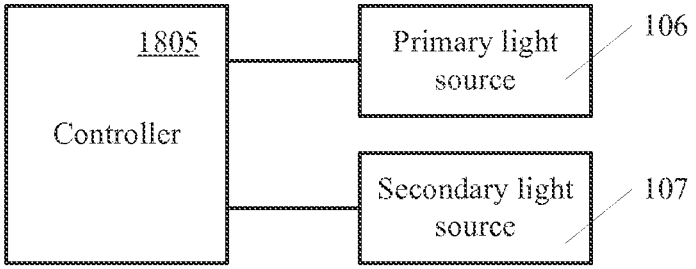
FIG. 18 schematically shows a block diagram of a controller coupled with a primary optical subsystem and a secondary optical subsystem.

FIG. 18 shows a block diagram of controller 1805 coupled with primary optical subsystem 1810 and secondary optical subsystem 1815. Controller 1805 can control power to the light sources. In embodiments, controller 1805 may control distinct light sources within primary optical subsystem 1810 and/or secondary optical subsystem 1815.

Controller 1805 can change the characteristic of the light emitted from primary optical subsystem 1810 and/or secondary optical subsystem 1815. For example, controller 1805 can be coupled with distinct light sources and/or dynamic filters to adjust the quantity of light and/or color of either or both primary optical subsystem 1810 and secondary optical subsystem 1815 throughout the day to correlate the quantity of light and/or color of light based on the time of day and/or day of the year. As one example, the produced light may be greater during midday and lesser at night. As another example, the produced light may include more red and yellow hues during sunrise and sunset. Controller 1805 may also be coupled with various actuators.

Controller 1805 may also adjust the brightness and/or color of the light based on real-time weather phenomena.

For example, the controller can include a network card (e.g., WiFi or cellular network card etc.) that communicates with a database that updates local weather conditions in real-time. Based on information in the database, the controller can change the quantity of light, brightness, gradient and/or spectrum of the light produced by either or both the primary optical subsystem 1810 and secondary optical subsystem 1815 based on real-time weather events. As another example, the controller can include a database of weather events and can randomly adjust the characteristic of light by randomly selecting a weather event from the database. In some embodiments, the controller can dynamically control the quantity of light, brightness, luminous or chromatic gradient and/or color of the light emitted from the primary and/or secondary light sources in any way; for example, in a way that is visually interesting or pleasing and/or that adds to the ambiance of the architectural space.

In embodiments, controller 1805 can provide independent control of a primary optical subsystem 106 and one or more secondary optical subsystems 107. This independent control can control the luminance, color, distribution, look, and/or feel of the light independently for the two optical subsystems. In some embodiments, controller 1805 can provide appearance compensation. For instance, when the emitted light of one optical subsystem changes from in appearance, the other subsystem can also change in order to compensate for the new look and feel of the overall system.

In embodiments, a plurality of luminaires and/or luminaire subsystems can be controlled in a coordinated fashion. That is, the temporal and/or spatial effects can be created among the plurality of luminaires and/or luminaire subsystems. For example, in a first state, each of the plurality of luminaires and/or luminaire subsystems can provide a static luminous presentation. In a second state, a "ripple" of color could be sent across the plurality of luminaires and/or luminaire subsystems. As another example, a user could specify a different color scheme for the secondary component of each of four corners of a two dimensional array of luminaires and/or luminaire subsystems. A combination of software and/or control system can be used to automatically blend/transition the color of all the other luminaires based on each one's relative spatial proximity of the plurality of luminaires and/or luminaire subsystems.

In some embodiments, controller 1805 can include a plurality of controllers and/or drivers. Moreover, in embodiments, controller 1805 can include multiple controllers distributed among a plurality of luminaries. Moreover, controller 1805 can include one or more light drivers.

Figure 19:
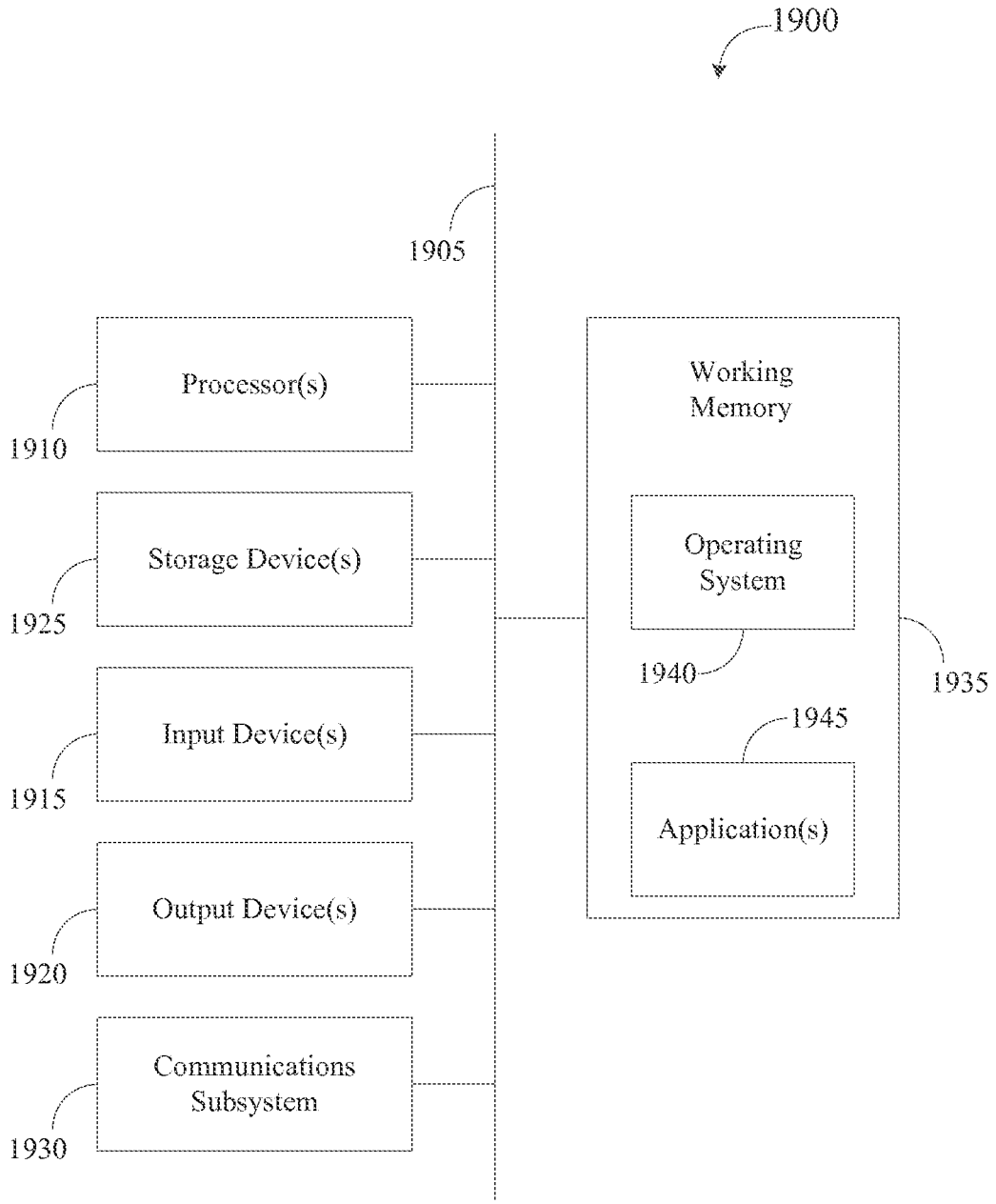
FIG. 19 schematically shows an illustrative computational system for performing functionality to facilitate implementation of embodiments described herein.

The computational system 1900, shown schematically in FIG. 19, can be used to perform control functions described herein. Controller 1805 can include all or portions of computational system 1900. As another example, computational system 1900 can be used to perform any program or simulation described herein. Furthermore, computational system 1900 can be used to control various LEDs and/or light sources.

Computational system 1900 includes hardware elements that can be electrically coupled via a bus 1905 (or may otherwise be in communication, as appropriate). The hardware elements can include one or more processors 1910, including without limitation one or more general-purpose processors and/or one or more special-purpose processors (such as digital signal processing chips, graphics acceleration chips, and/or the like); one or more input devices 1915, which can include without limitation a mouse, a keyboard and/or the like; and one or more output devices 1920, which can include without limitation a display device, a printer and/or the like.

The computational system 1900 may further include (and/or be in communication with) one or more storage devices 1925, which can include, without limitation, local and/or network accessible storage and/or can include, without limitation, a disk drive, a drive array, an optical storage device, a solid-state storage device, such as a random access memory ("RAM") and/or a read-only memory ("ROM"), which can be programmable, flash-updateable and/or the like. The computational system 1900 might also include a communications subsystem 1930, which can include without limitation a modem, a network card (wireless or wired), an infrared communication device, a wireless communication device and/or chipset (such as a Bluetooth device, an 802.6 device, a WiFi device, a WiMax device, cellular communication facilities, etc.), and/or the like. The communications subsystem 1930 may permit data to be exchanged with a network (such as the network described below, to name one example), and/or any other devices described herein. In many embodiments, the computational system 1900 will further include a working memory 1935, which can include a RAM or ROM device, as described above.

The computational system 1900 also can include software elements, shown as being currently located within the working memory 1935, including an operating system 1940 and/or other code, such as one or more application programs 1945, which may include computer programs of the invention, and/or may be designed to implement methods of the invention and/or configure systems of the invention, as described herein. For example, one or more procedures described with respect to the method(s) discussed above might be implemented as code and/or instructions executable by a computer (and/or a processor within a computer). A set of these instructions and/or codes might be stored on a computer-readable storage medium, such as the storage device(s) 1925 described above.

In some cases, the storage medium might be incorporated within the computational system 1900 or in communication with the computational system 1900. In other embodiments, the storage medium might be separate from a computational system 1900 (e.g., a removable medium, such as a compact disc, etc.), and/or provided in an installation package, such that the storage medium can be used to program a general purpose computer with the instructions/code stored thereon. These instructions might take the form of executable code, which is executable by the computational system 1900 and/or might take the form of source and/or installable code, which, upon compilation and/or installation on the computational system 1900 (e.g., using any of a variety of generally available compilers, installation programs, compression and/or decompression utilities, etc.) then takes the form of executable code.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. That is, while this invention has been described with an emphasis upon certain embodiments, it will be obvious to those of ordinary skill in the art that variations of the embodiments may be used and that it is intended that the invention may be practiced otherwise than as specifically described herein. The teachings herein are contemplated as being applicable in any combination, whether or not explicitly disclosed as such. Accordingly, the present invention is not limited to the embodiments described above or depicted in the drawings, and various embodiments and modifications can be made without departing from the scope of the claims below. In particular, it should be noted that the following specific combinations of features are possible:

a) A two-component luminaire for illuminating an architectural space may include at least a housing, including at least a panel that faces the architectural space. A peripheral edge of the housing may form an output aperture that faces the architectural space, with a first edge segment of the peripheral edge bounding a first panel section of the panel, and a second edge segment of the peripheral edge being across the output aperture from the first edge segment. A plane normal to the panel and bisecting the output aperture may define a boundary between an indirect lighting region and a direct lighting region, wherein the first edge segment and first panel section are within the direct lighting region, and the second edge segment is within the indirect lighting region. The luminaire may further include a primary optical subsystem that is arranged within the housing so as to be hidden from the direct lighting region by the first panel section, and configured to generate and emit light, through the output aperture, solely into the indirect lighting region, and a secondary optical subsystem, disposed within the housing and configured to generate and emit light through the output aperture.

b) In the two-component luminaire designated as (a) above, the primary optical subsystem may be configured to illuminate a surface that is substantially perpendicular to the panel and within the indirect lighting region.

c) In the two-component luminaires designated as (a) or (b) above, the light emitted by the secondary optical subsystem may be distributed across the output aperture.

d) The two-component luminaires designated as (a), (b) or (c) above may include a controller that independently controls one or more of lumen output, luminance, brightness, color and color temperature of the primary optical subsystem and the secondary optical subsystem.

e) In any of the two-component luminaires designated as (a) through (d) above, the primary optical subsystem may include a plurality of light sources disposed within the housing proximate the first edge segment and the first panel section.

f) In any of the two-component luminaires designated as (a) through (e) above, the secondary optical subsystem may include a plurality of light sources, each of the light sources emitting light of a different color than the others of the plurality of light sources. In any of these luminaires, each of the plurality of light sources may be independently controllable and/or arranged such that the light sources can create gradients of color and/or intensity across the output aperture, when the output aperture is viewed from the direct lighting region.

g) In any of the two-component luminaires designated as (a) through (f) above, the secondary optical subsystem may include one or more light sources that emit light of a single color.

h) In any of the two-component luminaires designated as (a) through (g) above, the secondary optical subsystem may include a light source selected from the group consisting of a plurality of multi-color light emitting diodes (LEDs), a liquid crystal display (LCD), an organic light emitting diode (OLED) display, an LED matrix, and a plasma display.

i) In any of the two-component luminaires designated as (a) through (h) above, the secondary optical subsystem may include a first plurality of light sources and a second plurality of light sources. Any of these two-component luminaires may further include a controller that independently controls the first plurality of light sources and the second plurality of light sources j) Any of the two-component luminaires designated as (a) through (i) above may include a diffuser within the housing. The primary optical subsystem may be disposed between the diffuser and the first panel section such that from the direct lighting region, the diffuser is substantially visible across the output aperture, but the primary optical subsystem remains hidden by the first panel section. In any of these luminaires, the diffuser may have a surface area larger than an area of the output aperture, and/or be concave with respect to the output aperture. In any of these luminaires, a majority of light from the secondary optical subsystem passes through the diffuser prior to emitting through the output aperture without light from the primary optical subsystem passing through the diffuser prior to emitting through the output aperture. In any of these luminaires, the housing may form a void corresponding to the output aperture between at least the first and second edge segments of the peripheral edge, and/or the diffuser may be collapsible such that it can be removed from the luminaire through the output aperture.

k) In any of the two-component luminaires designated as (a) through (j) above, the primary optical subsystem may include a plurality of light sources that produce substantially white light.

l) In any of the two-component luminaires designated as (a) through (k) above, the housing may include a plurality of sidewalls disposed proximate the peripheral edge of the output aperture, and extending perpendicularly into the housing from the peripheral edge. In any of these luminaires, the housing may be substantially rectangular, the second edge segment of the peripheral edge may be substantially horizontal when the luminaire is installed, a first one of the sidewalls may adjoin the second edge segment of the peripheral edge and extends perpendicularly into the housing therefrom, third and fourth edge segments of the peripheral edge may be substantially vertical when the luminaire is installed, each of the third and fourth edge segments connecting with the first and second edge segments proximate sides of the housing, and/or second and third ones of the sidewalls may adjoin the third and fourth edge segments respectively and extend perpendicularly into the housing therefrom.

m) In any of the two-component luminaires designated as (a) through (l) above, the housing may have a width that is less than 24 inches and/or a depth that is less than 3.625 inches such that the housing can be located within a wall between studs and without protruding from the wall.

n) In any of the two-component luminaires designated as (a) through (m) above, the output aperture may form a first output aperture. These two-component luminaire may also include a second output aperture, a second primary optical subsystem disposed to direct light though the second output aperture, a second secondary optical subsystem disposed to direct light though the second output aperture, and/or a controller configured to independently control one or more of: lumen output, luminance, brightness, color and/or color temperature of light emitted by the primary optical subsystem, the secondary optical subsystem, the second primary optical subsystem, and the second secondary optical subsystem.

o) A method of illuminating an architectural space may include providing a luminaire within a recess of a wall of the architectural space. The luminaire may include a housing, a first primary optical subsystem configured to emit a first light solely towards an indirect lighting region of the architectural space, while being hidden, by the housing, from view of a direct lighting region of the architectural space, and a first secondary optical subsystem. The method may further include activating the first primary optical subsystem to provide the first light into the indirect lighting region of the architectural space, and activating the first secondary optical subsystem to provide a second light into at least the direct lighting region of the architectural space.

p) The method designated above as (o) above may further include providing a second luminaire within a recess of a wall of the architectural space. The second luminaire may include a housing and a second secondary optical subsystem that has a lighting capability that matches a lighting capability of the first secondary optical subsystem. The method may further include activating the second secondary optical subsystem of the second luminaire to provide a third light into at least the direct lighting region of the architectural space from the second luminaire that matches the second light provided by the first luminaire, without providing the first light into the indirect lighting region from the second luminaire.

q) The methods designated above as (o) or (p) may designate the luminaire as a first luminaire, and include providing a second luminaire within a recess of a wall of the architectural space. The second luminaire may include a housing and a second secondary optical subsystem that has a lighting capability that matches a lighting capability of the first secondary optical subsystem. The methods may further include activating the second secondary optical subsystem of the second luminaire to provide a third light into at least the direct lighting region of the architectural space from the second luminaire that matches the second light provided by the first luminaire, without providing the first light into the indirect lighting region from the second luminaire.

r) A luminaire for illuminating an architectural space may include a housing that forms an output aperture facing the architectural space, and one or more optical subsystems, disposed within the housing, each of the optical subsystems including a plurality of red, green and blue light sources that are distributed in each of horizontal and vertical directions within the housing. The luminaire may further include a diffuser that at least partially mixes light from the light sources such that mixed light therefrom is visible through the output aperture. The red, green and blue light sources and the diffuser may be arranged and independently controllable so as to create at least one of horizontal and vertical gradients of at least one of color and intensity when viewed from the architectural space.

s) In the luminaire designated above as (r), the one or more optical subsystems may include a first optical subsystem disposed near a base of the housing and behind the diffuser as viewed from the architectural space, and a second optical subsystem disposed near a top of the housing and behind the diffuser as viewed from the architectural space. The red, green and blue light sources of the first and second optical subsystems may be independently controllable such that the first and second optical subsystems can create a vertical gradient of at least one of color and intensity, as viewed from the architectural space.

t) In the luminaires designated above as (r) or (s), the one or more optical subsystems may also include an optical subsystem disposed along a first lateral side of the housing and behind the diffuser as viewed from the architectural space, and an optical subsystem disposed near a second lateral side of the housing, across the output aperture from the first lateral side, and behind the diffuser as viewed from the architectural space. The red, green and blue light sources of these optical subsystems may be independently controllable such that these optical subsystems can create a horizontal gradient of at least one of color and intensity, as viewed from the architectural space.

u) In the luminaires designated above as (r), (s) or (t), the diffuser may be larger than the output aperture, and/or may be collapsible, and/or removable through the output aperture.

v) A luminaire for illuminating an architectural space may include a housing that forms an output aperture facing the architectural space. The housing and the output aperture may be substantially rectangular. The output aperture may form a peripheral edge, such that first and fourth segments of the peripheral edge at respective upper and lower sides of the output aperture are substantially horizontal, and second and third edge segments of the peripheral edge along sides of the output aperture are substantially vertical, when the luminaire is installed. The housing may include first, second and third sidewalls extending perpendicularly into the housing from the output aperture, wherein the first sidewall adjoins the first segment of the peripheral edge and extends perpendicularly into the housing therefrom, and the second and third sidewalls adjoin the second and third segments of the peripheral edge respectively, and extend perpendicularly into the housing therefrom. The luminaire may include one or more optical subsystems, disposed within the housing, each of the optical subsystems including a plurality of independently controllable red, green and blue light sources, and/or a diffuser, disposed behind the sidewalls from the architectural space, that at least partially mixes light from the light sources such that light mixed thereby is visible through the output aperture. In this luminaire, the housing may not include a sidewall adjoining the fourth segment of the peripheral edge and extending perpendicularly into the housing.

What is claimed is:

1. A two-component luminaire with a total light output having a total photometric distribution for illuminating an architectural space, comprising:

a housing, including at least a panel that faces the architectural space, wherein a peripheral edge of the housing forms an output aperture that faces the architectural space, a first edge segment of the peripheral edge bounding a first panel section of the panel, a second edge segment of the peripheral edge being across the output aperture from the first edge segment, and a plane normal to the panel and bisecting in half the output aperture defines a boundary between an indirect lighting region and a direct lighting region, wherein the first edge segment and first panel section are within the direct lighting region, and the second edge segment is within the indirect lighting region;

a diffuser positioned within the housing;

a primary optical subsystem that is arranged within the housing behind the first panel section so as to be hidden from view when viewed from the direct lighting region through the aperture perpendicularly to the panel, and configured to generate and emit light having a primary photometric distribution through the output aperture into the indirect lighting region; and a secondary optical subsystem, disposed within the housing and configured to generate and emit light having a secondary photometric distribution through the output aperture, wherein:

a majority of light from the secondary optical subsystem passes through the diffuser prior to emitting through the output aperture;

a majority of light from the primary optical subsystem does not pass through the diffuser prior to emitting through the output aperture; and the primary optical subsystem contributes more than 50% of the total light output of the two-component luminaire and wherein the total photometric distribution is asymmetric relative to the plane normal to the panel such that more light of the total light output is directed into the indirect lighting region compared to the direct lighting region.

2. The two-component luminaire according to claim 1, wherein the primary optical subsystem is configured to illuminate a surface that is substantially perpendicular to the panel and within the indirect lighting region.

3. The two-component luminaire according to claim 1, wherein the light emitted by the secondary optical subsystem is distributed across the output aperture.

4. The two-component luminaire according to claim 1, further comprising a controller that independently controls one or more of lumen output, luminance, brightness, color and color temperature of the primary optical subsystem and the secondary optical subsystem.

5. The two-component luminaire according to claim 1, wherein the primary optical subsystem comprises a plurality of light sources disposed within the housing proximate the first edge segment and the first panel section.

6. The two-component luminaire according to claim 1, wherein the secondary optical subsystem comprises a light source selected from the group consisting of a plurality of multi-color light emitting diodes (LEDs), a liquid crystal display (LCD), an organic light emitting diode (OLED) display, an LED matrix, and a plasma display.

7. The two-component luminaire according to claim 1, wherein the secondary optical subsystem comprises a first plurality of light sources and a second plurality of light sources, and wherein the two-component luminaire further comprises a controller that independently controls the first plurality of light sources and the second plurality of light sources.

8. The two-component luminaire according to claim 7, wherein the first and second pluralities of light sources are independently controllable to emit light of adjustable color and intensity, such that the light sources can create a gradient of one or both of color and intensity across the output aperture, when the output aperture is viewed from the direct lighting region.

9. The two-component luminaire according to claim 1, wherein the primary optical subsystem is disposed between the diffuser and the first panel section such that from the direct lighting region, the diffuser is substantially visible across the output aperture, but the primary optical subsystem remains hidden by the first panel section.

10. The two-component luminaire according to claim 1, wherein the diffuser:

has a surface area larger than an area of the output aperture, and is concave with respect to the output aperture.

11. The two-component luminaire according to claim 1, wherein:

the diffuser is collapsible such that it can be removed from the luminaire through the output aperture.

12. The two-component luminaire according to claim 1, wherein the primary optical subsystem comprises a plurality of light sources that produce substantially white light.

13. The two-component luminaire according to claim 1, further comprising a plurality of sidewalls disposed proximate the peripheral edge of the output aperture and extending perpendicularly into the housing from the peripheral edge.

14. The two-component luminaire according to claim 13, wherein the housing is substantially rectangular;

the second edge segment of the peripheral edge is substantially horizontal when the luminaire is installed;

a first one of the plurality of sidewalls adjoins the second edge segment of the peripheral edge and extends perpendicularly into the housing therefrom;

third and fourth edge segments of the peripheral edge are substantially vertical when the luminaire is installed, each of the third and fourth edge segments connecting with the first and second edge segments proximate sides of the housing; and second and third ones of the plurality of sidewalls adjoin the third and fourth edge segments respectively and extend perpendicularly into the housing therefrom.

15. The two-component luminaire according to claim 1, the output aperture forming a first output aperture, the two-component luminaire further comprising:

a second output aperture;

a second primary optical subsystem disposed to direct light through the second output aperture;

a second secondary optical subsystem disposed to direct light through the second output aperture; and a controller configured to independently control one or more of lumen output, luminance, brightness, color and color temperature of light emitted by the primary optical subsystem, the secondary optical subsystem, the second primary optical subsystem, and the second secondary optical subsystem.

16. The two-component luminaire according to claim 1, wherein at least 50% of light emitted by the primary photometric distribution is directed at an angle of 0° to 25° relative to the plane normal to the panel.

17. The two-component luminaire according to claim 1, wherein the secondary photometric distribution comprises a uniform distribution of light into the architectural space.

18. The two-component luminaire according to claim 1, wherein the secondary photometric distribution is substantially Lambertian.

19. The two-component luminaire according to claim 1, wherein the primary photometric distribution and the secondary photometric distribution at least partially overlap.

20. The two-component luminaire according to claim 1, wherein the primary photometric distribution emits light into the indirect lighting region but not into the direct lighting region, and wherein the secondary photometric distribution emits light into both the indirect lighting region and the direct lighting region.

21. A luminaire with a total light output having a total photometric distribution for illuminating an architectural space, comprising:

a housing that forms an output aperture facing the architectural space;

a plane perpendicular to and bisecting in half the output aperture, wherein the plane extends between a first optical subsystem and a second optical subsystem;

the first optical subsystem, disposed on a first side of the plane such that the first optical subsystem is within the housing near a first edge of the output aperture;

the second optical subsystem, disposed on a second side of the plane such that the second optical subsystem is within the housing near a second edge of the output aperture, the second edge opposing the first edge across the output aperture;

a diffuser within the housing; and each of the first and second optical subsystems including a plurality of colored light sources that are distributed in at least one of a horizontal direction and a vertical direction within the housing, wherein:

the colored light sources are arranged and independently controllable so as to create at least one of horizontal and vertical gradients of at least one of color and intensity across the output aperture when viewed from the architectural space;

a majority of light from the second optical subsystem passes through the diffuser prior to emitting through the output aperture;

a majority of light from the first optical subsystem does not pass through the diffuser prior to emitting through the output aperture;

the first optical subsystem emits light primarily toward the second side of the plane; and the first optical subsystem emits more light into the architectural space than the second optical subsystem such that the total photometric distribution from the luminaire is asymmetric relative to the plane such that more light of the total light output is directed toward the second side of the plane compared to the first side of the plane.

22. The luminaire for illuminating the architectural space according to claim 21, wherein:

the diffuser at least partially mixes light from the colored light sources such that mixed light therefrom is visible through the output aperture;

the second optical subsystem is disposed behind the diffuser as viewed from the architectural space; and the colored light sources of the first and second optical subsystems are independently controllable such that the first and second optical subsystems can create a gradient of at least one of color and intensity across the output aperture, as viewed from the architectural space.

23. The luminaire for illuminating the architectural space according to claim 21, wherein:

the first optical subsystem is disposed along a first lateral side of the output aperture;

the second optical subsystem is disposed along a second lateral side of the output aperture, across the output aperture from the first lateral side, and behind the diffuser as viewed from the architectural space; and the colored light sources of the first and second optical subsystems are independently controllable such that the first and second optical subsystems can create a horizontal gradient of at least one of color and intensity across the output aperture, as viewed from the architectural space.

24. The luminaire for illuminating the architectural space according to claim 21, wherein:

the housing and the output aperture are substantially rectangular; and the output aperture forms a peripheral edge, such that a first edge segment of the peripheral edge is substantially horizontal, and second and third edge segments of the peripheral edge are substantially vertical, when the luminaire is installed;

and further comprising:

a plurality of sidewalls extending perpendicularly into the housing from the output aperture, wherein a first one of the sidewalls adjoins the first edge segment of the peripheral edge and extends perpendicularly into the housing therefrom;

second and third ones of the sidewalls adjoin the second and third edge segments respectively, and extend perpendicularly into the housing therefrom.

25. The luminaire for illuminating the architectural space according to claim 21, wherein:

the first optical subsystem is disposed along an upper side of the output aperture aperture;

the second optical subsystem is disposed along a lower side of the output aperture, across the output aperture from the upper side, and behind the diffuser as viewed from the architectural space; and the colored light sources of the first and second optical subsystems are independently controllable such that the first and second optical subsystems can create a vertical gradient of at least one of color and intensity across the output aperture, as viewed from the architectural space.

26. The luminaire for illuminating the architectural space according to claim 21, wherein the first optical subsystem emits light toward the second side of the plane but does not emit light toward the first side of the plane.

27. A luminaire with a total light output having a total photometric distribution for illuminating an architectural space, comprising:

a housing that forms an output aperture facing the architectural space, wherein the housing and the output aperture are substantially rectangular, the output aperture forms a peripheral edge, such that first and fourth segments of the peripheral edge at respective upper and lower sides of the output aperture are substantially horizontal, and second and third edge segments of the peripheral edge along sides of the output aperture are substantially vertical, when the luminaire is installed, a plane perpendicular to and bisecting in half the second and third edge segments, the housing includes first, second, and third sidewalls extending perpendicularly into the housing from the output aperture, wherein the first sidewall adjoins the first segment of the peripheral edge and extends perpendicularly into the housing therefrom, and the second and third sidewalls adjoin the second and third segments of the peripheral edge respectively, and extend perpendicularly into the housing therefrom; and at least one optical subsystem disposed within the housing, each optical subsystem including a plurality of independently controllable red, green, and blue light sources that emit light; and a diffuser, disposed behind the first, second, and third sidewalls that at least partially mixes light from the light sources such that the at least partially mixed light is visible within and emitted through the output aperture, wherein:

a majority of light from one of the at least one optical subsystem passes through the diffuser prior to emitting through the output aperture;

a majority of light from another of the at least one optical subsystem does not pass through the diffuser prior to emitting through the output aperture; and wherein the at least one optical subsystem emits more than 70% of the emitted light above the plane such that the total photometric distribution of the luminaire is asymmetric relative to the plane and more light of the total light output is directed above the plane compared to below the plane.

* * * * *